United States Patent [19]

Schaumburg

[11] Patent Number: 4,557,125

[45] Date of Patent: Dec. 10, 1985

[54] APPARATUS FOR ON LINE, RANDOM SAMPLE, INSPECTION OF COLD-FORMED BLANKS FOR THREADED FASTENERS

[75] Inventor: Theodore R. Schaumburg, Elgin, Ill.

[73] Assignee: Pioneer Screw & Nut Co., Elk Grove Village, Ill.

[21] Appl. No.: 622,752

[22] Filed: Jun. 20, 1984

[51] Int. Cl.[4] ..... B21B 37/00

[52] U.S. Cl. ..... 72/12; 72/361; 72/426; 73/863.91

[58] Field of Search ..... 72/12, 352, 356, 360, 72/361, 426; 73/863.9; 250/223 R

[56] References Cited

U.S. PATENT DOCUMENTS 3,435,685 4/1969 Watkin et al. ..... 72/356

3,878,726 4/1975 Hamatant ..... 73/863.91

*Primary Examiner*—Leon Gilden

*Attorney, Agent, or Firm*—Norman Lettvin

[57] ABSTRACT

An improved apparatus for on-line inspection of an intermediate-stage, headed, non-threaded blank for a threaded fastener is disclosed. If the blank fails to meet specifications, the production of blanks is terminated. Improvement features include a roll-sorter for testing all blanks to see if certain dimensional parameters of the blank's head are satisfied. Then, random chosen acceptable blanks are fed to a rotatable table which is constructed to receive a sample blank for movement of the blank to a test station where the blank is tested for other failures to meet dimensional specifications. The rotatable table is constructed to provide interchangeable elements thereof that will accept blanks of different head and stem sizes. Multiple adjustability is provided in the means for transferring blanks, that are first acceptable to the roll-sorter test, on to the rotatable table for further testing.

11 Claims, 27 Drawing Figures

FD
X
Y
H
T
D
d
HA
OC
SA
DR
W
R-1
R-2
T-1

FIG. 13
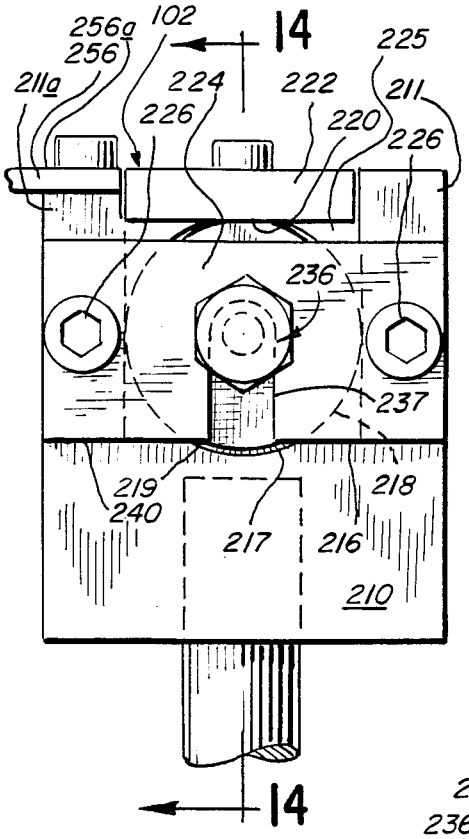
FIG. 12
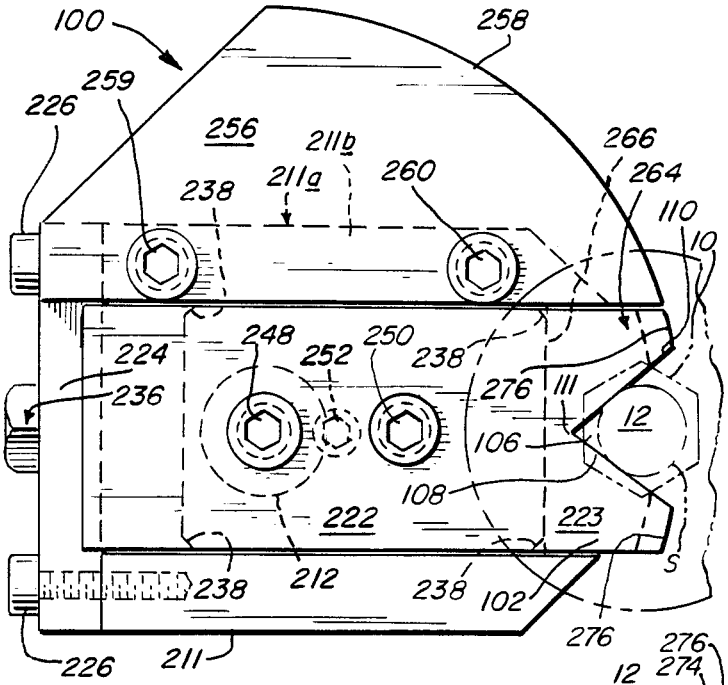
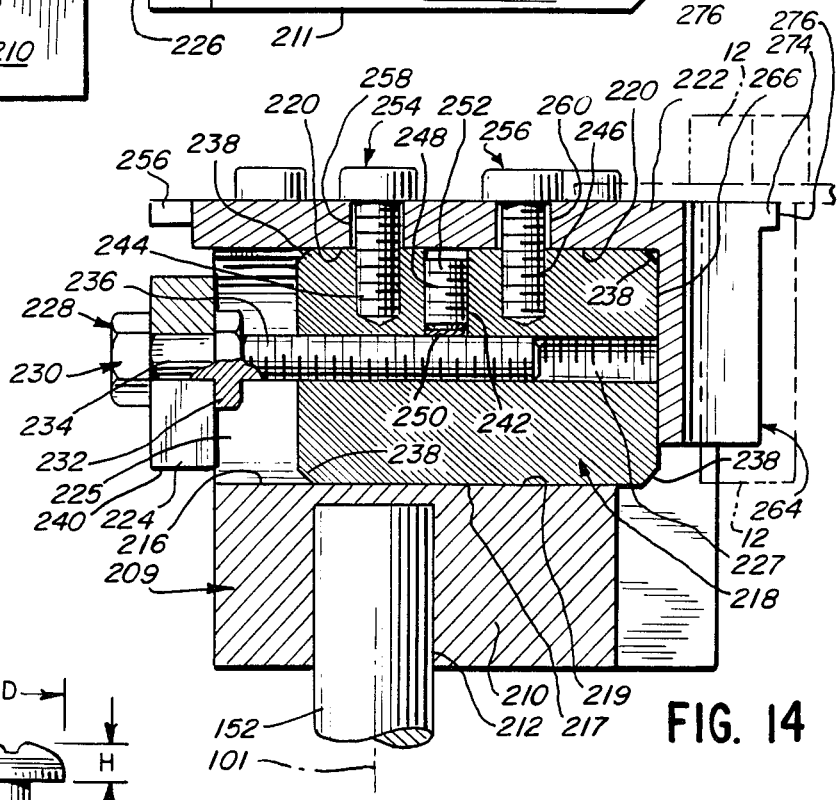
FIG. 14
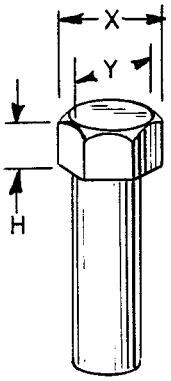
FIG. 1F
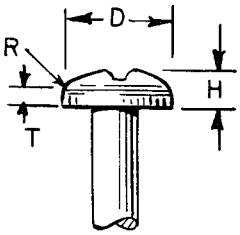
FIG. 1G
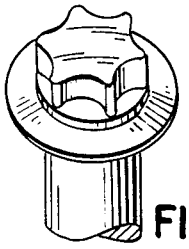
FIG. 1H
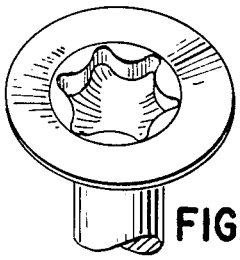
FIG. 1J

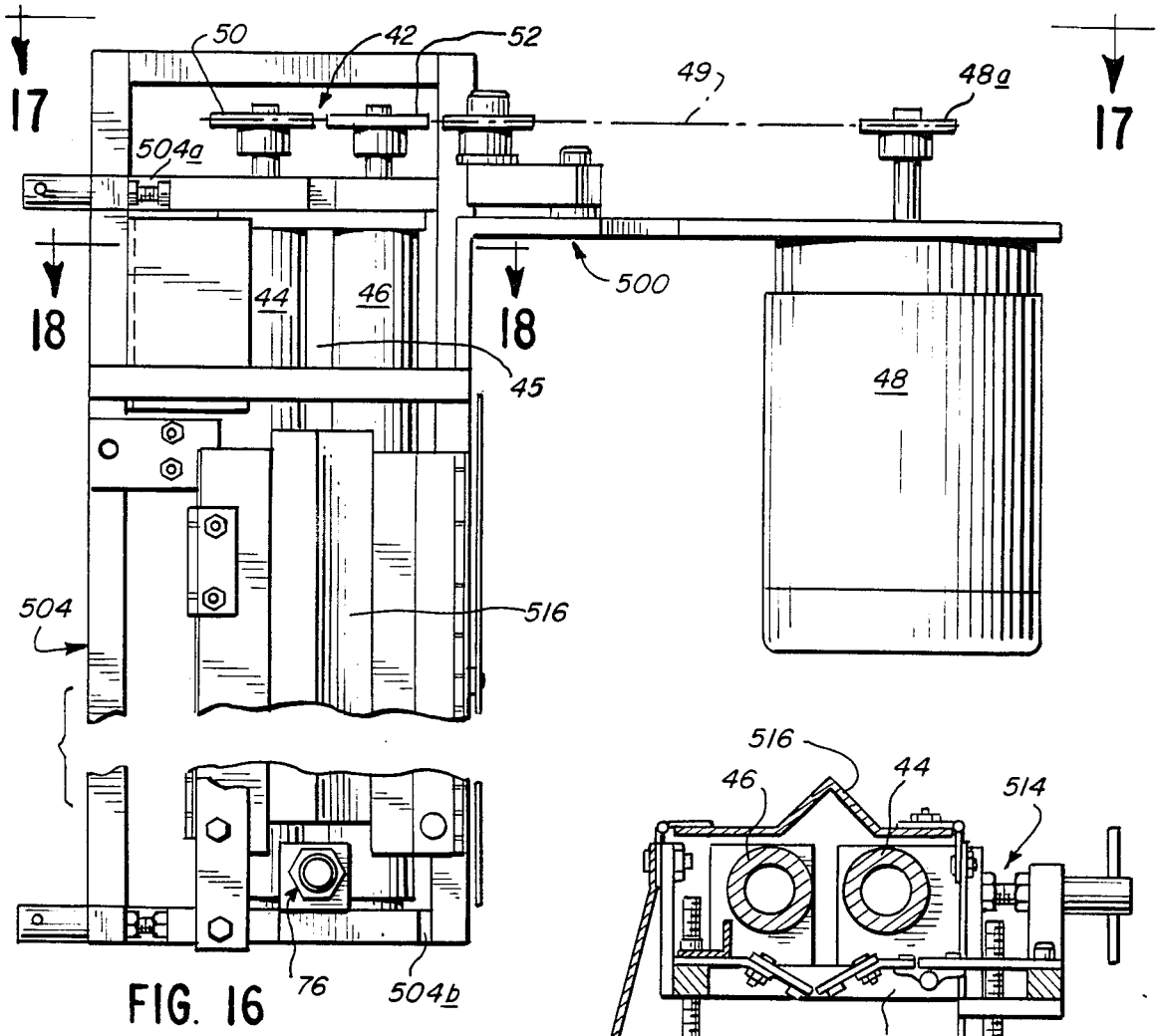
FIG. 16
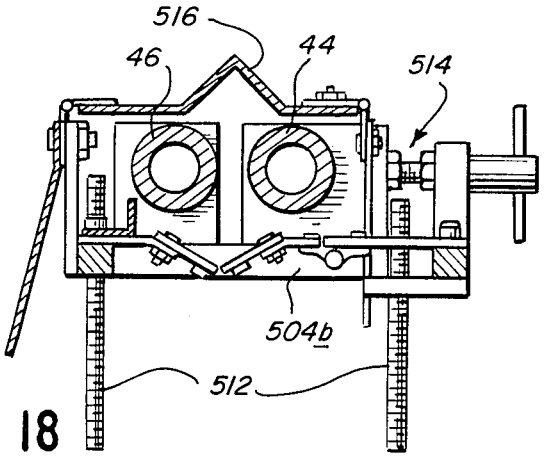
FIG. 18
FIG. 17
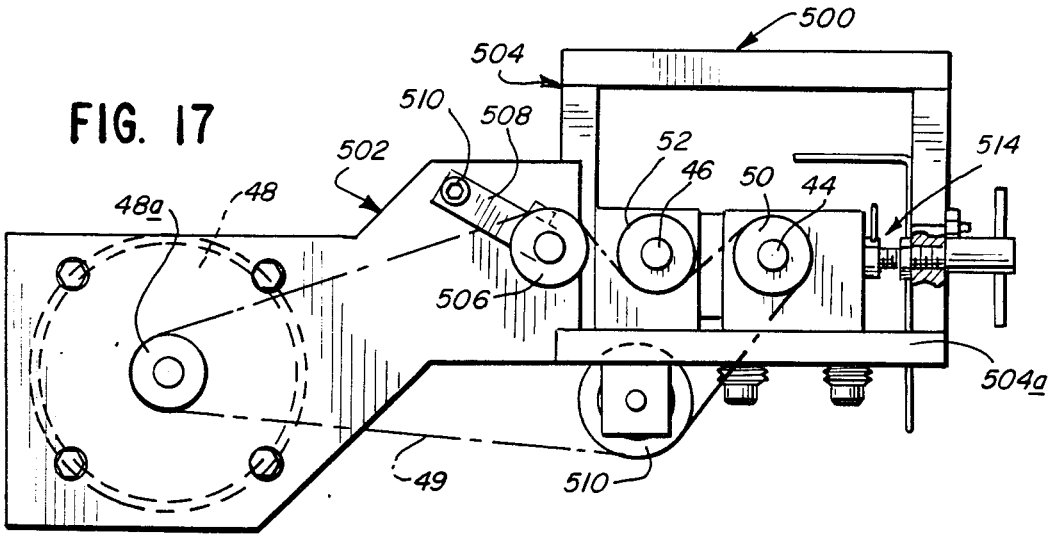

APPARATUS FOR ON LINE, RANDOM SAMPLE, INSPECTION OF COLD-FORMED BLANKS FOR THREADED FASTENERS

BACKGROUND OF THE INVENTION

This invention relates to an apparatus for on line inspection of an intermediate-stage product, namely headed, nonthreaded blanks for subsequently threaded fasteners. The blanks are produced in a continuous stream by a cold forming machine, and production of blanks is stopped when the inspecting apparatus detects a flaw in the output of the cold forming machine.

In the production of headed, threaded fasteners, it has long been known to feed selected wire stock to a machine that automatically severs a blank segment, from a supply of wirestock, and cold forms the severed segment into a headed intermediate blank. Rolling machines later cold form threads into the blank stem of the headed intermediate product. A typical headed intermediate blank provides an axially elongated stem that extends from one end of a fastener's head which is of enlarged diameter relative to that of the stem. Both the stem and head are cold-formed.

One form of intermediate product provides a head section which includes a hex head that terminates in a integral washer. The free end of the hex head is provided with a hex-shaped, axially elongated, drive socket, and the integral washer is of greater diameter than either the head or the unthreaded stem. The term "drive socket", or "recess", when used herein refers to a shaped indentation in the head section of a fastener that is intended for use with a driver for the fastener, and is to be distinguished from a mere indentation in a fastener's head that merely exists to save some weight of the material used to form the fastener. The washer is located at the junction between the hex head and the stem, or shank. Other typical intermediate blanks for fastener members provide, in the enlarged head at one end of the blank stem, a "Phillips"-shaped, drive socket, adapted to receive therein a "Phillips"-head driver, or a "Pozi"-drive socket, or other drive sockets such as a "Torx" socket and other sockets that are known in the trade and are adapted to receive driving tools thereinto. The "Torx" drive system not only refers to a recessed hex-lobed socket but also to a hex-lobed axial projection.

Such blanks, when their respective stems, or work-entering ends are threaded, become fasteners and may be used in vast quantities in certain industries, such as the automotive industry. It is desirable, and may even be critical, that all recessed head drive systems, that are adapted to receive therein a drive, such as the hex-socketed, "Phillips", "Pozi", slotted, "Torx", and other such fasteners should be made to conform to exacting specifications in order for the automated equipment that install the fasteners to function satisfactorily. It is therefore important that the intermediate blanks be accurately formed.

The cold forming of metal parts by automatic machines has been known for many years, and the problems associated with avoiding production of defective parts has been known for the same length of time. In the manufacture of intermediate blanks by automatic machines that cold form wire stock segments into the finished blank, it has been found that the cold-forming tool that is most likely to fail is the one that makes and shapes the blank's head. Variations in specified maximum dimensions of the head end of the blank are one result of such failure that may require rejection of a blank, or of the resulting fastener. Other defects are lack of concentricity of head and blank stem, and incorrect depth of the end recess, or drive socket, of hex-socketed, "Phillips"-headed, "Pozi"-drive, and other like fasteners. It is estimated that a large majority of all failures in production of machine screw fasteners occur in the portions of the fastener's blank other than in its stem. Problems in the formation of the stem, itself, will usually be reflected in the head of the fastener. It has also been observed that the process of cutting segments from the supply of wire stock, to provide the blank segment which is then cold-formed into the intermediate headed blank, is extremely reliable. A critical phase in threaded fastener manufacture is, therefore, in the cold-forming of the intermediate blank.

A first known type of in-process control device utilizes as the principal, significant, control-parameter a force-time signal, that is, a measurement of force applied at the time of fastener blank formation. The force is measured by a sensor which generates signals, that are fed to an electronic processor which is programmed to recognize signals that reflect distortions in the fastener formation, and to initiate machine shut-off. Such a system and instrument is called "Processor-SE" and has been offered for sale in the United States by Brankamp Process Automation, Inc. of Lexington, Mass.

A second approach to the same problem uses, as input, information as to load levels developed in the machine that is forming the headed blank stem parts. By using load-sensing transducers and comparing changes in the force levels in the metal working tooling, through and with an electronic comparator, the system is able to determine if the producing machine should be shut down. Such a system is known by the trademark "PARTGARD", which is offered in the United States by Helm Instrument Co., Inc. of Toledo, Ohio.

Still another approach to the problem has been to provide multiple separate monitors to monitor forces generated in the cold-forming machine, to monitor the part-forming punch in order to detect any significant wearing or breaking and to monitor the output blanks to detect variations in the length of the blank stem. Such a system is known as "Auto-checker", offered by Yarisute of Osaka, Japan and available in the United States through the Shinsho American Corp. of Lake Bluff, Ill.

It is generally believed that failures in formation of fasteners will, with very high probability, be determined by examination of multiple features at the head of the blank. Determination of variation in stem length are often eschewed because length variations of a cold-formed blank product, formed from a substantially fixed volume blank segment, are likely to result in measurable dimensional, and/or geometrical variations in the blank's head, or in the axial alignment of the blank's head with the stem's axis.

A system known under the name "HEADSTART", and offered by HI-TEC SEIKO, of Japan, provides alternate systems, each dedicated to the testing of only a single headed blank, especially one of the kind that has been recessed during cold-forming to provide a blank for either a hex washer head screw, or a Phillips head screw. The "HEADSTART" system feeds a sample blank through and along a vertical slot bounded by a pair of support rails, for supporting the blank's head, and spaced a fixed distance apart and arranged to discharge the forwardmost blank into an elongated, U-shaped, recess provided in the edge of a rotatable table. The table then rotates to move the sample headed blank to a test station. A gauging apparatus at the test station is lowered to engage and to rotate the blank and to provide entry of a gauge into the recess in the blank's head. A spring loaded, crank arm lever feeler, is positioned to engage the outer surface of the rotating blank. The lever feeler measures eccentricity of the axis of the blank's head relative to the axis of the blank's stem, or in the case of hex washer head blanks, the feeler measures corner build up adjacent the washer. The "HEADSTART" system, because of its dedication to testing only multiple duplicates of a single part, fails to provide flexibility for testing runs of blanks of different sizes, and therefore is considered to be inadequate for usage in a factory facility that may use a single production machine that can, when desired, be modified to produce runs of different sized fastener blanks.

T. Hamatani, in U.S. Pat. No. 3,878,726 discloses a structure for advancing a selected sample of a batch of coldformed headed cross-holed screws to a testing apparatus. The testing apparatus measures the depth of engagement of a cross-pointed gauge shaft with the cross hole, referred to as a Q value, of each screw of the sample. In the form of measurement disclosed, electrostatic capacity between a rotary drum attached to the gauge shaft and a fixed electrode is measured to determine the amplitude of motion of the gauge shaft.

Watkin, et al. in U.S. Pat. No. 3,435,685 had earlier disclosed the broad concept of an apparatus for sampling and measuring physical parameters of discrete objects by selectively withdrawing a sample from a stream of discrete objects and measuring that sample. Hamatani uses the same general concept disclosed in said earlier patent to Watkin et al., but provides a different apparatus for making measurements on the sample.

The first two systems described above use complex electronic systems to make measurements that are related to the operation of the machine in the formation of the blank, rather than by checking the actual blank itself. The third system primarily checks features that are related to the operation of the machine, but it also measures a single dimensional variable in the output blank, namely the length of the wire cut off, to determine whether production by the machine is satisfactory. In the "HEADSTART" and Hamatani systems, the machine will not catch a defect in the blank that involves unusual distortion, such as a laterally enlarged washer, or a washer that is too small, or a hex-head of unusually reduced height above the washer. Also, these systems use machines that are dedicated to only one specific product, and hence lack versatility.

Systems that rely upon monitoring of the cold-forming machine, rather than by monitoring the dimensions of the blanks themselves, rely upon the inference that the product is accurately formed if the forming machine operates, within predetermined tolerances, in a predetermined manner. It is believed, however, that checking the headed blank is more reliable, and ultimately less expensive, than checking the operation of the machine that produces the product.

SUMMARY OF THE INVENTION

One object of this invention is to provide means for automatically effecting reliable, periodic, assaying of the continuous output by machines, of cold-formed, headed intermediate blanks for fasteners and the like, by determining the acceptability to preliminary specifications of each intermediate blank, the preliminary specifications being a subset of the specifications to be assayed.

Another object of this invention is to provide means for effecting reliable, periodic assaying of the output by automatic machines of cold-formed, headed intermediate blanks, for ultimate formation into screw type fasteners, by determining if specified maximum head-size dimension, concentricity of head and stem, and depth and central location of the head-end of the blank of the fastener fall within the dimensional specifications for the ultimate finished fastener.

Still another object of this invention is to provide, in a machine for assaying fastener blanks produced by cold forming and wherein the same cold forming machine may be used to produce successive runs of cold formed fastener blanks of different specifications and configurations, the use of an apparatus that is not dedicated to examining only a single type, style, or desired group of dimensions of the output of a single run of blanks, but instead has the character of multiple adjustability, so that the same machine has blank testing character adaptable for potential use with a variety of runs of blank sizes produced by the coldforming production machine that feeds blanks to be assayed. The various adjustabilities of the improved machine include all of the following features: first, testing the dimension of all fastener blank heads to determine if they fall between preset minimum and maximum dimensions; second, providing a sampling, and aligning, downwardly inclined, track means, for receiving thereinto random sample blanks that pass said first test, the track means defining an elongated slot for receiving the stem of the blank, while providing spaced rails for support of the blank therefrom, and the width of the slot being selectively adjustable to have said slot dimension adjusted to permit a slide fit, not too tight or too loose, of a blank stem of a particular size that is to pass along and through said slot; third, the track means being longitudinally adjustable, selectively, to insure proper spacing, for the transfer of blanks moving along the track means to a sample-accepting, rotatable sampling head, on a testing table; and fourth, the sample-accepting, rotatable testing table having a vertically extending V-shaped notch, and vertical walls conforming with and serving as extensions of the edges of the V-notch, for receiving the stem of an acceptable blank, and for then rotating the table so as to move the blank that is lodged in the V-notch in timed relation to a test station where tests of the blank's head dimensions, shape and eccentricity relative to the axis of the stem may be performed; and fifth, the vertically extending V-shaped notch and its corresponding vertical walls being a portion of a single part that may be readily interchanged and substituted, to provide for and insure the presence of proper dimensions of the rotatable table, so as to insure properly receiving the stem of the blank on the rotating table, in a manner that permits proper rotation of the table top, and of the fastener blank along a predetermined path to the testing station where the head of the blank is tested by other test means.

Further objects and advantages of this invention will become apparent to one skilled in the art as the features of the invention will be explained in these specifications, having reference to the accompanying drawings.

BRIEF DESCRIPTION OF THE DRAWINGS

FIG. 1F, on sheet 6 of the drawings illustrates a hex-head blank that is another type of intermediate, headed, blank that can be examined for defects by the apparatus disclosed herein;

FIG. 1G, shown on sheet 6 of the drawings illustrates a slotted pan-head blank that is another type of intermediate, headed, blank that can be examined for defects by the apparatus disclosed herein;

FIG. 1H, shown on sheet 6 of the drawings illustrates an external, hexlobular head design, with an integral washer, known in the trade by the trademark "TORX", that is another type of intermediate, headed, blank that can be examined for defects by the apparatus disclosed herein;

FIG. 1J, shown on sheet 6 of the drawings illustrates an internal, hexlobular head design, with an integral washer, also sold under the trademark "TORX", that is another type of intermediate, headed, blank that can be examined for defects by the apparatus disclosed herein;

FIG. 12 is an enlarged top plan view of a selected portion of the rotatable table shown in FIGS. 2, 5 and 6, showing certain details of the table's construction that permits of easy substitution and interchange of the blank-holding element of the table, to accommodate receiving into the notch thereon fastener blanks of different shank sizes;

FIG. 13 is an end elevational view of the rotatable table portion shown in FIG. 12, looking from the left of FIG. 12;

FIG. 14 is a cross-sectional view of the rotatable table portion shown in FIGS. 12 and 13, and is taken looking substantially along section line 14—14 shown on FIG. 13;

FIG. 16 is a fragmentary top plan view of the frame for the mounting the roll-sorter means that are shown only in part in FIG. 2, and the drive means for driving the two rolls of the roll-sorter in opposite directions;

FIG. 17 is primarily a diagrammatic view taken on line 17—17 of FIG. 16, showing the arrangement and path of the drive means for causing the rolls of the roll-sorter means to rotate in opposite directions; and FIG. 18 is a cross-sectional view of the roll-sorter means taken substantially on line 18—18 of FIG. 17, and showing further details of the roll-sorter means that are shown only in fragmentary perspective in FIG. 2 for purposes of clarity of FIG. 2.

DETAILED DESCRIPTION OF PREFERRED EMBODIMENTS OF THE INVENTION

Figures 1, 1A, 1B, 1C, 1D, 1E, 2, 3, 4:
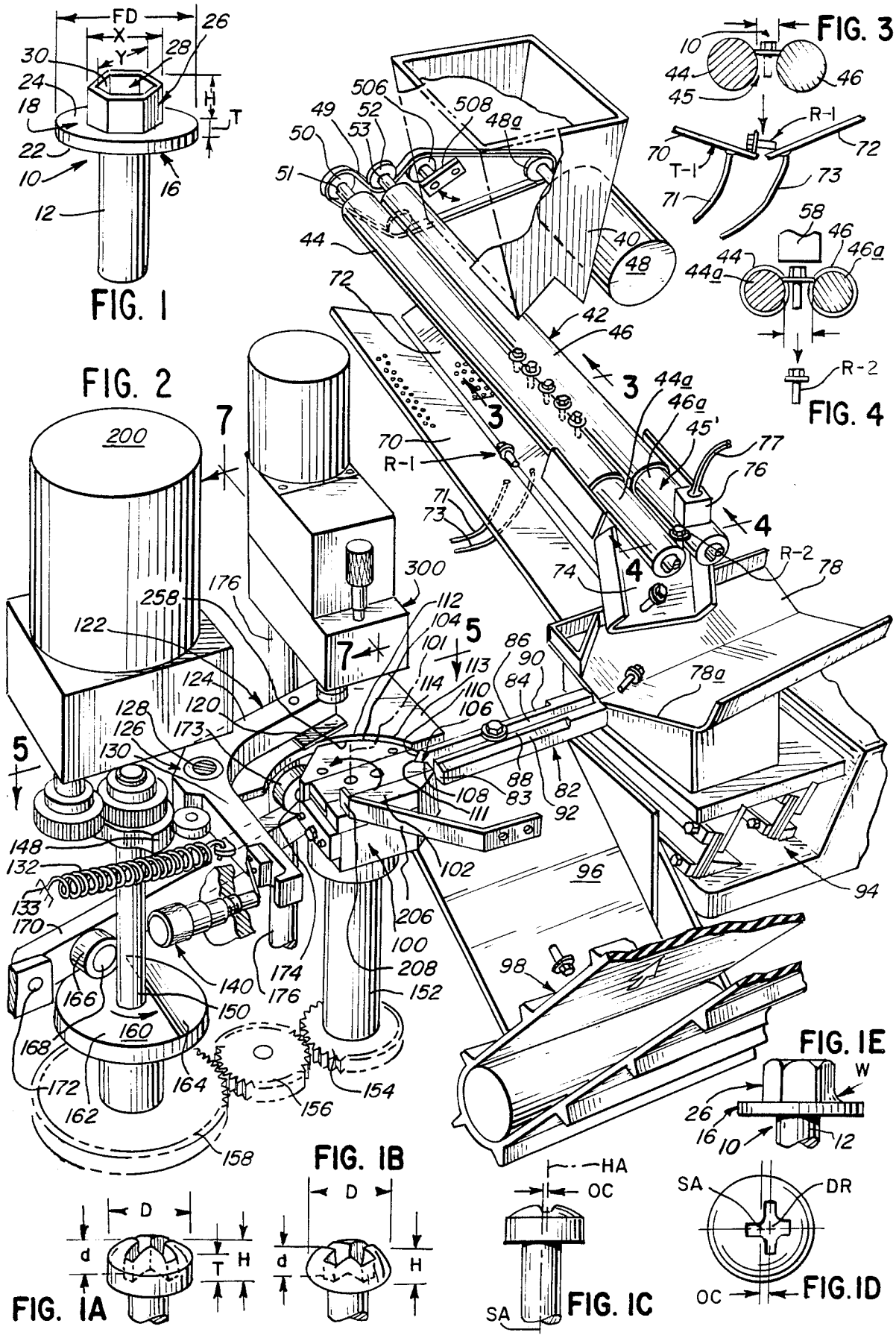
FIG. 1 is a perspective view of one type of cold-formed, intermediate product, namely a recessed hex washer head and stem that can be inspected by the apparatus disclosed herein.
FIG. 1A is a perspective, fragmentary, view of a second type of cold-formed, intermediate product, namely a Phillips fillister head and stem, that can be inspected by the apparatus disclosed herein.
FIG. 1B is a perspective, fragmentary, view of a third type of cold-formed, intermediate product, namely a Phillips round headed fastener and stem, that can be inspected by the apparatus disclosed herein.
FIG. 1C is a side elevational view of a fragment of one type of cold-formed, intermediate product, namely the type shown in FIG. 1B, but for purposes of illustrating one type of defect that makes the intermediate product rejectable, namely existence of an off-center condition between the geometrical axis of the blank's head and the geometrical axis of the stem of the blank, a defect that can occur in any of the blanks shown in FIGS. 1, 1A or 1B.
FIG. 1D is a top plan view of another type of defect that may occur in any of the blanks of FIGS. 1A or 1B, namely an off-center condition of the center of the recess in the head of the blank, although the axes of the head and stem themselves are not offset.
FIG. 1E illustrates another form of detectable defect that may occur, particularly in the fastener of FIG. 1, namely creation of a fillet of material, W, between the outer surface of a corner of the hex head and the integral washer portion.
FIG. 2 is a perspective, illustrative layout view showing both: (a) only certain of the operative elements of a roll-sorter means for determining the acceptability of the maximum head dimension of a fastener blank, between pre-established maximum and minimum dimensional specifications, the remainder of the structure of the roll-sorter means being shown in detail in FIGS. 16–18 described hereinafter; and (b) some of the related elements of a machine used for periodically assaying random samples of output, from a cold-forming machine, of headed blanks of the various types shown, but specifically showing the fastener of FIG. 1 being assayed.
FIG. 3 is a diagrammatic cross-sectional view of one section of the roll-sorter shown in FIG. 2, and is taken substantially along line 3—3 of FIG. 2 and showing how defectively dimensioned, undersized washers are determined.
FIG. 4 is a cross-sectional view of another section of the roll sorter shown in FIG. 2, and is taken substantially along line 4—4 of FIG. 2, and showing how defectively dimensioned over-sized washers of hex-head washer blanks are determined.

Referring now to the drawings, FIG. 1 illustrates generally a hex-headed, integrally washered blank 10 that is cold formed by an automatic machine as known in the art. As seen, blank 10 has an elongated cylindrical stem 12 that is yet to be threaded, and an integral head end 16 for a hex washer head, the head end 16 including a washer-like enlargement 18, at the head end of stem 12, that serves as part of the integral head end 16 of the blank 10. The washer-like enlargement has an underside 22 and an upper side 24. Centrally of the washer-like enlargement 18 is the remainder of the blank's head which includes a hex-walled, upstanding projection 26 extending axially from and above washer 18, and surrounding a central recess 28 bounded laterally by the hex walls of projection 26 and with an open top 30. The lower end of recess 28 does not extend below the plane of upper side 24 of the washer 18. In FIG. 1 the diameter of washer 18, that is part of the head of the blank 10, is designated "FD" in FIG. 1, and is a critical dimension that is to be measured by a roll sorter, shown in FIGS. 2–4. As seen in FIG. 1, the dimension across opposite corners of the hex-head is designated by letter "X", and is commonly known as the across-corner dimension. The maximum dimension across the flats of the hex-head is designated by letter "Y" and is known or referred to, as the across-flats dimension. The depth of the recess surrounded by the walled hexhead shown in FIG. 1 is designated by the letter "H". The thickness of the washer 18 is designated by the letter "T". As shown in FIG. 1E, failure to form a blank 10 with a sharply delineated hex-walled projection 26 may typically result in a fillet, or enlargement, "W" at the junction of a corner of the hex-head projection 26 and the top of washer 18.

The blank 10, as is known in the art, is cold formed from a pre-selected segment, or blank, of wire to provide the shape shown. Since the segment of wire has a pre-selected volume of metal, the formation of the stem 12, washer-like enlargement 18, and hex-walled projection 26 have a relationship to each other such that the sum of the volumes of material forming the stem 12, washer 18, and projection 26 must equal the original volume of the wire segment. Since the axial length sizing of the preselected segment, or blank, is usually very accurate, variations, if any, will occur in the distribution of the excess of remainder of material in the integral head end 16, distributed between the washer 18 and the hex-walled projection 26. If the thickness and diameter of washer 18 are formed accurately, within defined limits, then the remaining material must be in the hex-walled projection 26, and it is in this latter part that most departures from accurate production occurs.

FIG. 1A shows a fillister headed blank having an axially elongated head section, H, with a maximum outer diameter section, D, which, although of greater axial depth than washer 18 of FIG. 1, may be measured for correctness, within specified limits, of its maximum diameter, in the same manner as described hereinafter for measuring the washer 18 of FIG. 1. Also, the head section of the fillister-headed blank of FIG. 1A can be assayed for eccentricity relative to the blank's stem in the manner hereinafter described with respect to the blank of FIG. 1.

FIG. 1B shows a round-head blank with a maximum outer diameter "D" at the lower end of the head. It, too, is capable of being assayed for correctness within specifications of its maximum diameter and also for eccentricity, as described hereinafter in connection with the blank of FIG. 1.

The heads of the blanks shown in FIGS. 1C, 1D and 1E are capable of having their maximum head dimension width determined in the same way as described hereinafter with respect to the blanks of FIGS. 1A and 1B.

FIG. 2 diagrammatically illustrates the apparatus which receives and handles headed blanks, of the type illustrated in FIG. 1, and in FIGS. 1A through 1G inclusive, in accord with features of this invention.

In FIG. 2, the machine which cold-forms a blank of the general type shown in FIGS. 1, 1A, 1B, 1F and 1G, is not shown. Such machines form no part of the invention except that they make the blanks and are to be controlled by being shut down by signals from sensing apparatus disclosed herein.

The output from the cold-forming machine that makes the blank of FIG. 1 is first directed into a bottom-discharging box, or hopper, 40 that is positioned above a roll sorter, generally indicated at 42, and details of which are described hereinafter in connection with the description of FIGS. 16–18. It will be understood that output from the blank forming machine may be directed, in a continuous stream of output, into the upper open end of hopper 40. As shown, the hopper 40 has inclined sides which direct the blanks through a constricted open-bottomed slot which is positioned for discharge above and onto the central portion of the opposed rolls of a roll-sorter 42.

The operative portion of the roll-sorter 42 includes two elongated, parallel rollers 44 and 46 which are arranged to rotate toward each other. Many of the structural details of apparatus associated with the roll-sorter have been omitted from FIG. 2, so as to avoid showing excessive detail that could detract from clearly illustrating the flow of blanks through the testing apparatus that is intended to be shown illustratively in the single FIG. 2. However, the details omitted from FIG. 2 are shown in FIGS. 16–18 and will be described hereinafter in connection with the description of those FIGS. A rotating motor, or drive means, 48 is operatively associated with drive means, which are shown in greater detail in FIGS. 16 and 17, for rotating the two rollers 44 and 46. The parallel rollers 44 and 46 are appropriately journalled and are adjustable toward and away from each other, by means shown in FIGS. 16–18, to define a desired spacing between the rollers 44 and 46 that is generally indicated at 45. An endless belt, or chain drive train 49, transmits motion from the drive sprocket 48*a* of motor 48 to rollers 44 and 46 by rotating a first drive sheave, or sprocket 50 that is drivingly connected to roller 44, and second drive sheave, or sprocket 52 that is drivingly connected to roller 46 to cause journal shafts 51 and 53 to rotate synchronously and in opposite directions. As best seen in FIG. 17, roller 46 is selectively adJustable relative to the other roller 44 to vary the spacing 45 between them, thereby providing that the roll sorter can accommodate production run output of fastener blanks of different sizes coming from a production machine. The drive train, as seen in FIG. 2, but as best disclosed in FIGS. 16 and 17 operates to cause rollers 44 and 46 to rotate in unison and oppositely, with the portion of the periphery of the two rollers that are closest to each other, as seen in FIGS. 3 and 4, moving upwardly to prevent any tendency to jam a headed blank between the two rollers, and with roller 44 rotating, as seen in FIGS. 2–4, counterclockwise, and roller 46 rotating clockwise. The spacing 45 between the rollers 44 and 46 is sufficient to have the stems of the blanks enter therebetween and to project downwardly, as illustrated in FIG. 3.

Each of the rollers 44 and 46 of roll-sorter 42 has a large diameter section and a smaller diameter section as shown in FIGS. 2–4. The spacing between the large diameter sections of rollers 44 and 46 is selected to be such that if the blank 10 is in the position as seen in FIG. 3, and if the maximum diameter "FD" of washer 18, of the head end of the blank, is accurately formed and lies between the specifications' upper and lower size limits as specified, then the washer 18 will bridge the two rollers 44 and 46 and not pass between the rollers under force of gravity.

On the other hand, if the washer 18 is undersized, below the specified minimum dimension for dimension "FD", then the blank passes between the rollers 44 and 46 and falls onto a tray T-1. Tray T-1 includes a pair of elongated, spaced, conductor plates 70 and 72 that are foraminous, as seen in FIG. 2, and are inclined downwardly and toward each other, but spaced from each other, so that any blank, such as defective reject R-1, that falls between rollers 44 and 46 will be urged toward the bridging position shown in FIG. 3. Each of plates 70 and 72 are connected respectively to a wire conductor 71 and 73 that is part of an electric circuit. When a defective, or reject, blank R-1 (so designated because it is the first basis for rejection) falls onto tray T-1 and bridges the plates 70 and 72, an electric circuit is completed through the wire conductors, plates, and the defective blank R-1. The completed circuit then signals the fact that the production machine is producing defective blanks, and means are actuated that immediately shut off further production by the production machine. This permits an operator to correct the situation and effect the necessary adjustments to avoid the undersize condition that produced the reject R-1.

The roll sorter 42 is arranged, such as by being slightly inclined downwardly from left to right as seen in FIG. 2, so that non-rejected blanks 10 will move longitudinally of the position of discharge hopper 40 toward a second section 45' of the roll sorter that has opposed sections 44*a* and 46*a* of smaller diameter and consequently of greater spacing 45*a* between roller peripheries as seen in FIGS. 2 and 4. The reduction in effective size of rollers 44 and 46, respectively to 44*a* and 46*a*, is provided so that the diameter of acceptable washers 18, to about the maximum specified dimension "FD", will pass between the reduced diameter rollers sections 44*a* and 46*a*, and fall through the roll sorter onto an inclined transfer wall, or chute 74.

However, if the diameter of washer 18, which is the maximum diameter of the head section of the blank, is in excess of the specified design maximum, and is therefore defective, the blank R-2 (so designated because it is a second basis for rejection) seen in FIGS. 2 and 4 will remain in position on sections 44*a* and 46*a* of rollers 44 and 46 moving axially therealong toward the right hand end of the roll sorter 42. As the defective, or reject, blank R-2 continues to move axially along roll sorter 42, it passes a proximity switch 76 (that is sensitive to passage of metal adjacent thereto) that is electrically connected by lead 77 to means that issues a signal that blank R-2 is defective. The signal from lead 77 operates to immediately shut off production of blanks by the cold-forming production machine.

The acceptable blanks 10, whose washers 18 are neither too small, as is the case with reject R-1, or too large, as is the case with reject R-2, have already discharged from the roll sorter 42 onto the inclined transfer wall, or chute, 74. All such blanks whose maximum head dimension is acceptable will then be transferred by gravity from transfer wall 74 to a second inclined transfer shelf or tray 78, whose shape includes a central bowing, or lazy V-shape, that is constructed to funnel accepted blanks toward a transfer track section 82.

Figure 5:
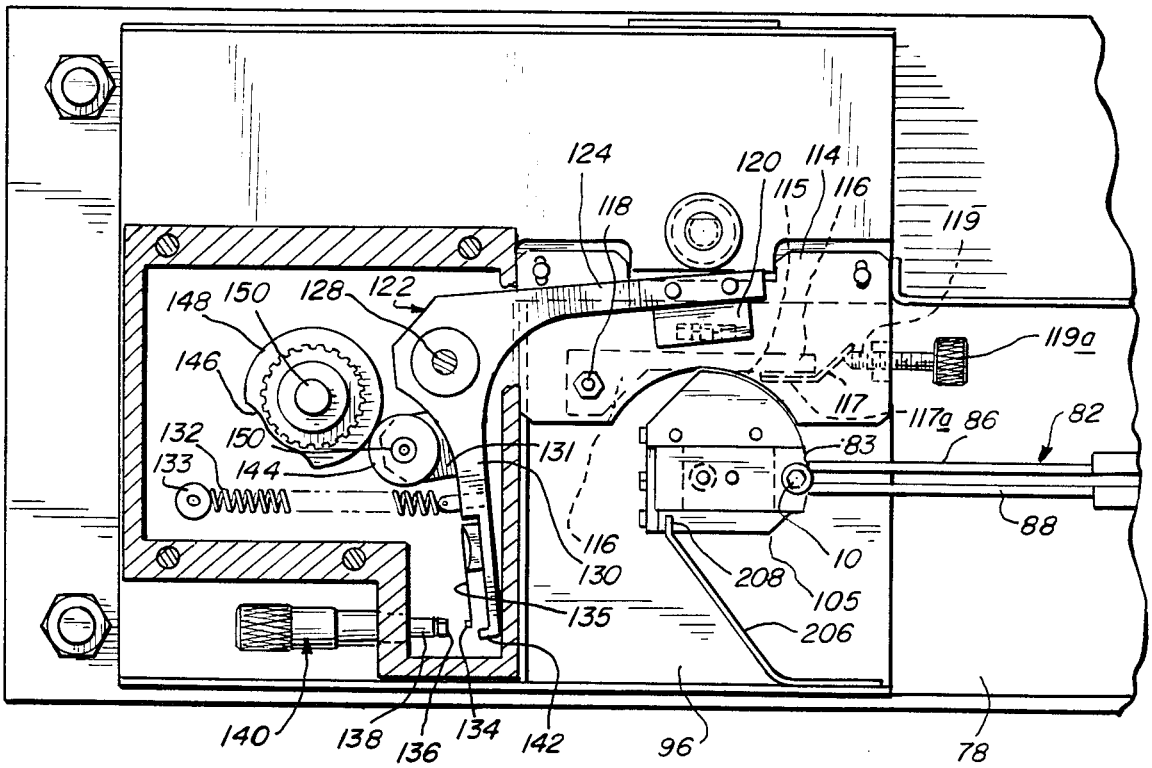
FIG. 5 is an enlarged, top plan, illustrative view of an improved, rotatable sampling head testing table, for the machine of FIG. 2, shown in its position for picking up a specimen of an intermediate formed blank, of the type shown in FIG. 1, from a rail transfer means, that is adaptable for use with intermediate formed blanks of different size blank stems and different head configurations.
Figure 6:
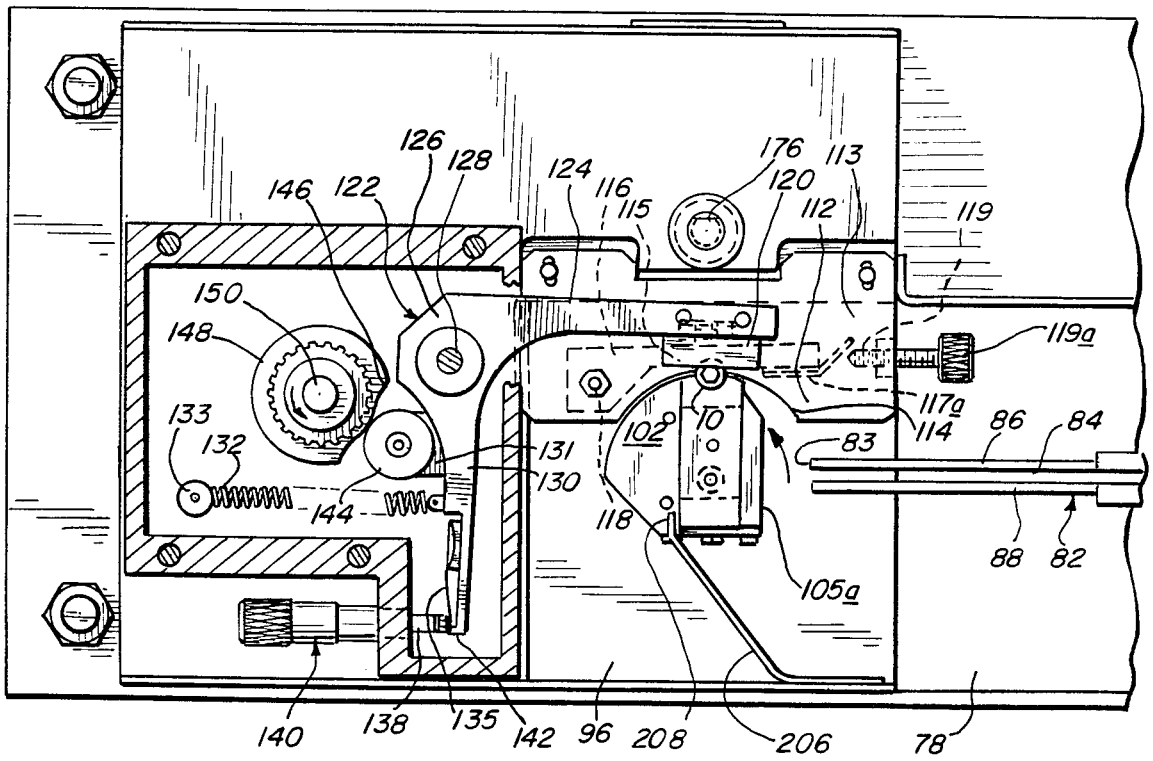
FIG. 6 is a view similar to FIG. 5, but showing the rotatable sampling head testing table moved counterclockwise to a position about 90° away from the position shown in FIG. 5, where both a laterally moving gauge and a vertically movable gauge are arranged to engage the head of the intermediate-formed blank, to examine the blank for eccentricity of head relative to the stem, depth of recess in the head, and for defects at cross corner locations specifically on hex-headed blanks.

The transfer track section 82, seen in FIGS. 2, 5 and 6, is located in line with the bend, or lowest section of the lazy V-shaped transfer tray 78. By this arrangement, random ones out of many acceptable blanks are caused to become aligned with a vertical slot 84 in and along track section 82. The stem 12 of a blank that moves onto the track section 82 thereby enters the track's slot 84 with the underside of washer 18 supported on the upper edges 86 and 88 of spaced rails 90 and 92 which bound slot 84.

Although only a few blanks 10 are shown in FIG. 2 for purposes of clarity of illustration, it should be understood that R-1 and R-2 are exceptions to the vast majority of blanks 10 that are satisfactory at this point of checking their dimensions, and large numbers of blanks 10 drop onto transfer wall 74 and from there to tray 78.

The tray 78 is mounted on, or connected to, a vibrator apparatus, generally 94, and, as well known in the art for vibratory moving of articles, the vibratory motion and action from vibrator 94 urges the blanks 10 to move toward the lower left hand edge 78*a* of inclined tray 78, as seen in FIG. 2. The great majority of blanks, approved to this point of assaying, move over the edge 78*a* of tray 78 to drop onto another inclined transfer shelf 96 and from there onto a flighted, continuously moving, belted conveyor 98, which is shown only in fragment in FIG. 2, for transfer to another station. A relatively small, random sampling of approved blanks will become aligned with the entry end of transfer track section 82, and will enter such transfer track section. As another blank enters the track section 82, the vibratory movement of the track section 82 causes the entire line of blanks to move toward the discharge end 83 of track section 82. During normal operation, therefore, the slot 84 will be filled with a row of blanks, and entry of each new blank into the row accompanies a blank moving off of the discharge end 83 of track section 82.

The rails 90 and 92 of track section 82 are to be selectively adjustable, individually or simultaneously, toward and away from each other to permit enlarging or reducing the width of slot 84 of the transfer track section. Such adjustments permit field correlation of the slot width with the size of the blank's stem, such as the stem 12 in FIG. 1.

A blank 10 at the discharge end 83 of track section 82 is to be fed onto a rotating table 100 when the opportunity arises for such action. Table 100 is shown in FIGS. 2, 5 and 6 and in greater constructional detail in FIGS. 12–14. The table 100 has thereon a flat top side 102, and a segment of a cylindrical upright side wall, with a cylindrical arcuate edge section 104 associated therewith. The cylindrical side wall segment 104 has an axis that is concentric with the axis of rotation 101 of table 100. Between the arcuately spaced ends of the cylindrical side wall segment 104, there is formed a vertically extending V-notch 106, of a vertical height to extend through the entire height of table 100, and whose edge traces 108 and 110 are straight and intersect at an apex 111 so that a radius from the axis of rotation 101 bisects the included angle of the V-notch 106. The V-notch 106 is used on table 100 whenever the head of a blank is not tapered on its underside for ultimate use with a countersunk hole. Heads shaped for use as part of a countersunk fastener have inclined under surfaces which will develop forces against the upper edges of traces 108 and 110 that could cause movement of a blank radially outwardly of V-notch 106. When using counter-sunk heads provided on headed blanks, a rectangular notch, instead of a V-notch 106, is provided on the rotatable table 100. With a rectangular notch, the biasing forces are laterally balanced, and there is no tendency of the headed blank to move outwardly, as would occur if a countersunk, or tapered under side of a head, would be used with a V-notch 106.

Additional side wall portions of the table 100 are cut away along chords of the imaginary cylinder of which cylindrical side wall section 104 is a part, thereby providing relief spaces 105 (See FIG. 6). Blanks 10 may fall off the discharge end 83 of track section 82, through such relief spaces 105, onto the inclined transfer shelf 96, when the table is rotated to a position where no portion of the V-notch 106, or of the adjacent cylindrical side wall section 104, is opposite discharge end 83 of track section 82.

The V-notch 106, with its two straight sides that correspond with edge traces 108 and 110 (See FIGS. 2 and 12), provides a blank-receiving recess that, when aligned with discharge end 83 of transfer track 82, readily accepts therein the stem 12 of a blank 10 that moves off of the discharge end 83 of transfer track section 82, while the depth of the V-notch and the included angle between V-notch traces 108 and 110 operate to properly and precisely locates the axis of the blank's stem 12. This is in contrast with the use of radially-elongated, parallel walled, slots, as employed in prior art sample-receiving, rotable tables. Also, the upper edges of the two spaced rails 90 and 92 of track 82, which engage and support the underside of washer 18 of blank 10, are located in a plane located slightly above the plane of the upper side 102 of table 100, thereby insuring an easy and no-jamming transfer of a blank 10 from transfer track section 82 onto table 100. The means for aligning and spacing the discharge end 83 of transfer track section 82 in relation to upper side 102 and V-notch 106 is disclosed hereinafter in connection with the detailed description of FIG. 11.

As best seen in FIGS. 5 and 6, after a blank, such as 10, has moved into the V-notch 106, the table 100 is rotated approximately 90° about the axis of rotation 101 to a dwell position, or testing station, shown in FIG. 6.

After the V-notch 106 has moved from its position in FIG. 5 to the dwell position in FIG. 6, the blank to be tested is held between the V-notch 106 and a spaced confining wall 112 with a circularly shaped edge 114 providing a concentric surrounding relation with the uppermost portion of the cylindrical side wall 104 of the table 100. The top surface 113 of confining wall 112 is selected and arranged to be located coplanar with the topside 102 of rotatable table 100. Thus, in the position shown in FIG. 6, the stem 12 of a blank 10 is located in the pie-shaped space, defined by upright walls of the V-notch whose horizontal traces are lines 108 and 110 of notch 106, and the opposite spaced cylindrical edge 114. The blank is tested dimensionally, and made to rotate about its stem axis, while located in the pie-shaped space, at the dwell station shown in FIG. 6, by means that will be described subsequently.

Since the maximum diameter portion of the head of the blanks shown in FIGS. 1 and 1A–1J, inclusive, are each greater than the maximum diameter of the blank's stem, a portion of the blank's head will, as seen in FIGS. 6 and 12, overlie a portion of table top 102, and also of top surface 113 of confining wall 112, when the sample blank for examination is in the position shown in FIG. 6. As can be best seen in FIG. 12, when a blank is positioned in V-notch 106, and the surface of cylindrical stem 12 engages walls 108 and 110 of V-notch 106, there is still a portion of stem 12 that extends outwardly of circular trace 104 of the table 100. In order to insure that the stem 12 does not tilt, a resilient pressure pad 115 is positioned below confining wall 112 and mounted on arm 116 that is pivoted about a pivot mounting 118 and is spring biased about its pivot mounting to a position for engagement of resilient pad 115 with stem 12.

Extending from the distal end of arm 116 is an inclined tab 117 that is electrically isolated from arm 116 by an insulator **117*a* between tab 117 and arm 116. The inclined tab 117 is positioned to cooperate with the tip end of an adjustable screw 119. An electrical signal is provided either by contact, or breaking, of engagement between tab 117 and screw 119. At the testing position seen in FIG. 6, with the arm 116 pivoted counter-clockwise about pivot mounting 118, there is no complete circuit through tab 117 and screw 119, and this serves to inform the electrical sensing system that there is a part to be gauged. The lack of a completed electrical signal circuit by reason of tab 117 and screw 119 being spaced apart, operates, as is well known in the signalling art associated with logic circuitry, to inform the machine's logic circuitry that the checking of the part at the position shown in FIG. 6 may proceed. If there is an electrical contact between tab 117 and screw 119, the electrical signal is arranged not to find a fault, if no part is located in the checking position of FIG. 6 for a period of two cycles of the rotation of table 100. If the contact persists for more than two rotations of table 100**, the circuitry is programmed to consider this a "fault", and operation of the machine is shut down.

There are a number of examinations to be performed on the sample blank 10 when it is in the position shown in FIG. 6. It should be noted that the examinations hereinafter described are not to be performed on a blank with a flat head, or on a blank with a non-circular head such as an oval head. However, the blade could be modified to perform the examinations on such heads. The examinations hereinafter described can be performed on a blank having a hex-head with integral washer, or on a blank with an ordinary hex-head, or on a blank with a fillister head (as shown in FIG. 1A), or a blank with a round, or semispherical, head (as shown in FIG. 1B), or on a blank with a panhead (as shown in FIG. 1G), or on the headed blanks shown in FIGS. 1H and 1J. One of such tests is to determine if there is axial misalignment, or eccentricity, between the axis of the head portion and the axis of the stem of the blank.

A hex-headed blank of FIG. 1F (or other multi-sided head blank), on the other hand, has apices located on a theoretical circle with a center coinciding with the axis of the blank's stem. Eccentricity can, therefore, be determined by checking whether any one of the apices is located spaced from the theoretical circle. Eccentricity is illustrated by the spacing O.C. (off-center) of the head axis HA relative to the stem axis, SA, as seen in FIG. 1C, or illustrated by the spacing O.C. (off-center) of the geometrical center of the drive recess DR from the stem axis SA, such as shown in FIG. 1D. Also, a portion of the height H of a round-head fastener of FIG. 1B provides a set of circular sidewall traces, examination of any one of which permits determination of existence of an eccentricity. The existence of a fillet, W, of the type shown in FIG. 1E, results in the apex of that corner with the fillet W being measurable as not located on the same circle as the other apices.

To check unacceptable eccentricity of a blank's head, and/or presence of a defect such as fillet W, illustrated in FIG. 1E, a swingable feeler blade 120 is provided, mounted on the crank arm 124 of a crank 122 and located in a testing plane spaced above the table top surface 102, and in a plane for engaging a section of the head of a blank. The crank 122 has a first elongated arm section 124 which carries feeler 120, an elbow section 126 which is apertured to receive therethrough, and to pivot about, an upright pivot shaft 128, and a second elongated crank arm section 130 that extends transversely, at about a right angle, to the first crank arm 124. The crank arm 122 is normally biased by a coil tension spring 132, that is anchored at one end at 133, and is attached at its other end to the second elongated arm 130. The tension spring bias forces the feeler 120 in a direction to engage against a rotating portion of the blank's head, such as against the cross corners of hex-head 26 above washer 18 (as seen in FIG. 1), or against a portion of the cylindrical wall of the fillister head blank of FIG. 1A, or against a circular portion of the side wall of the round head of the blank shown in FIG. 1B. If the feeler 120 follows the contour of a rotating head of a blank without the feeler being moved radially outwardly by a defect, such as an eccentricity, then the blank's head has passed the test.

If the feeler 120 moves radially inwardly or outwardly excessively as the blank's head rotates, the variation in radial movement of the feeler 120 closes or opens a pair of contacts 34, 136 (as best seen in FIGS. 5 and 6) to open or complete a circuit transmitting an electric signal that operates to shut down the blank-producing machine.

As shown in FIGS. 5 and 6, the second section 130 of crank 22 carries a resilient, electrically conductive, contact blade 135 with the contact 134 thereon, which is normally spaced from the electrically conductive tip 136 of an electrical conductive stem 138, that is arranged to be axially adjusted by a micrometer control 140. As feeler 130 moves radially inwardly, under the bias of spring 132, and as the feeler 130 follows the eccentric condition on the head of the fastener, the contact 134 on spring blade 135 is caused to engage contact 136 to complete a signaling circuit condition. The contact 136 can be position adjusted to select the degree of eccentricity needed to complete a circuit through contacts 134 and 136, by using a variable position micrometer stem 138 of the micrometer 140 that is mounted on an adjacent housing wall. The stem 138 carries at its end, or is integral with, the contact 136 and is positioned to be engaged by a safety 142 carried on the extended end of the arm 130 of bell crank 122. When the safety 142 is engaged by the stem 138, the pair of contacts 134, 136 are closed. The logic of the circuitry of the system is selected as desired, so that if contact 134 is spaced from contact 136, the system may be considered to be measuring a defect, and then an appropriate signal, leading to automatic shut down of production, will occur. This approach to signalling, and to determining when shut down of production should occur will be understood by a person skilled in the art of logic circuitry.

The crank 122 is caused to pivot timely, into the feeling position illustrated in FIG. 6, about the axis of pivot shaft 128 through means of a rotatably mounted cam follower 144 carried on an extension 131 of crank arm 130. The cam follower 144 is positioned to ride along a shaped cam edge 146 formed on the periphery of a cam wheel 148, which is rotated by a timed drive shaft 150 which rotates in timed relationship to the rotation of table 100. As seen in FIG. 2, the table 100 is rotated together with shaft 150, that in turn carries, and is rotated through, a gear 154 that is part of a drive train. The gear 154 is driven through transfer gear 156 by a drive gear 158 which rotates with the shaft 150 upon which the cam wheel 148 is mounted.

Figure 7:
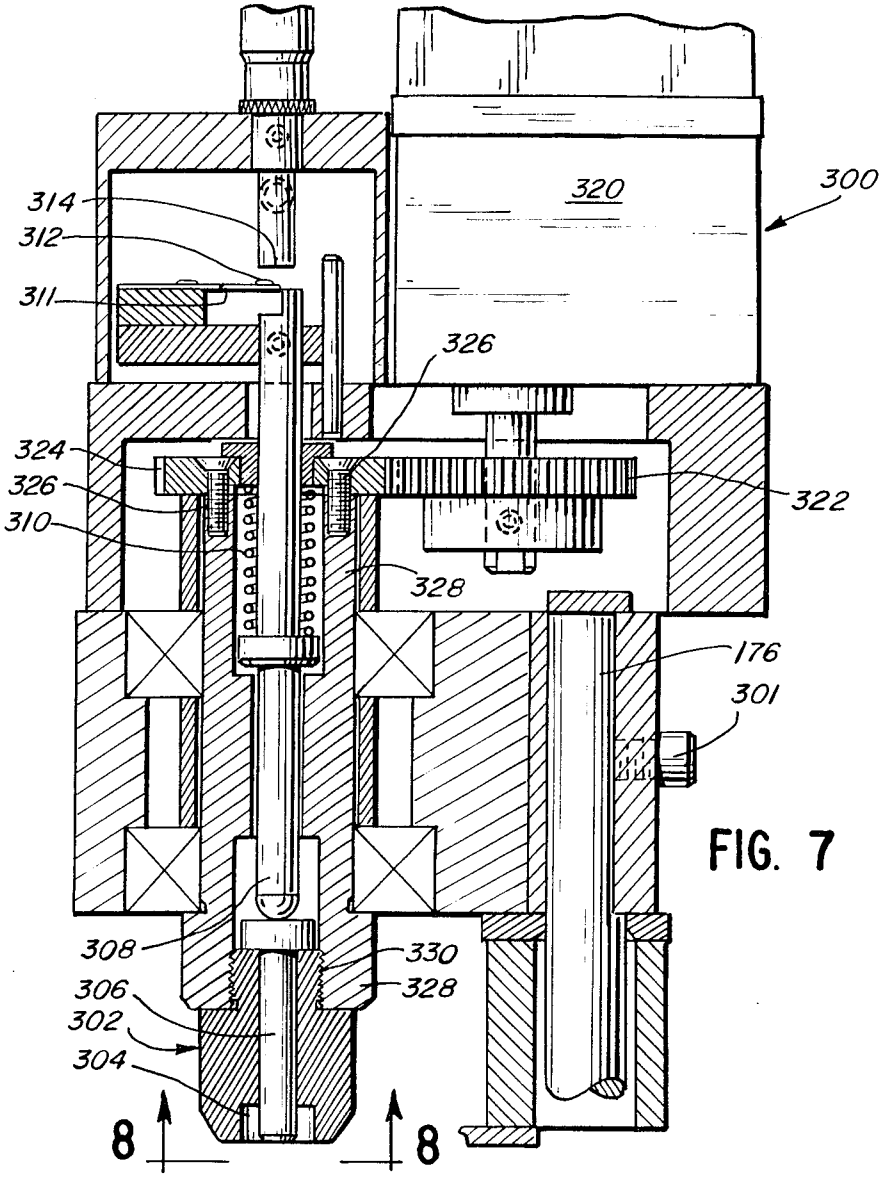
FIG. 7 is an enlarged, diagrammatic, cross-sectional view of an interchangeable, head-engaging means for rotating and testing a hex-headed blank, that is provided with a centrally depressed recess of the type as shown in FIG. 1.
Figure 9:
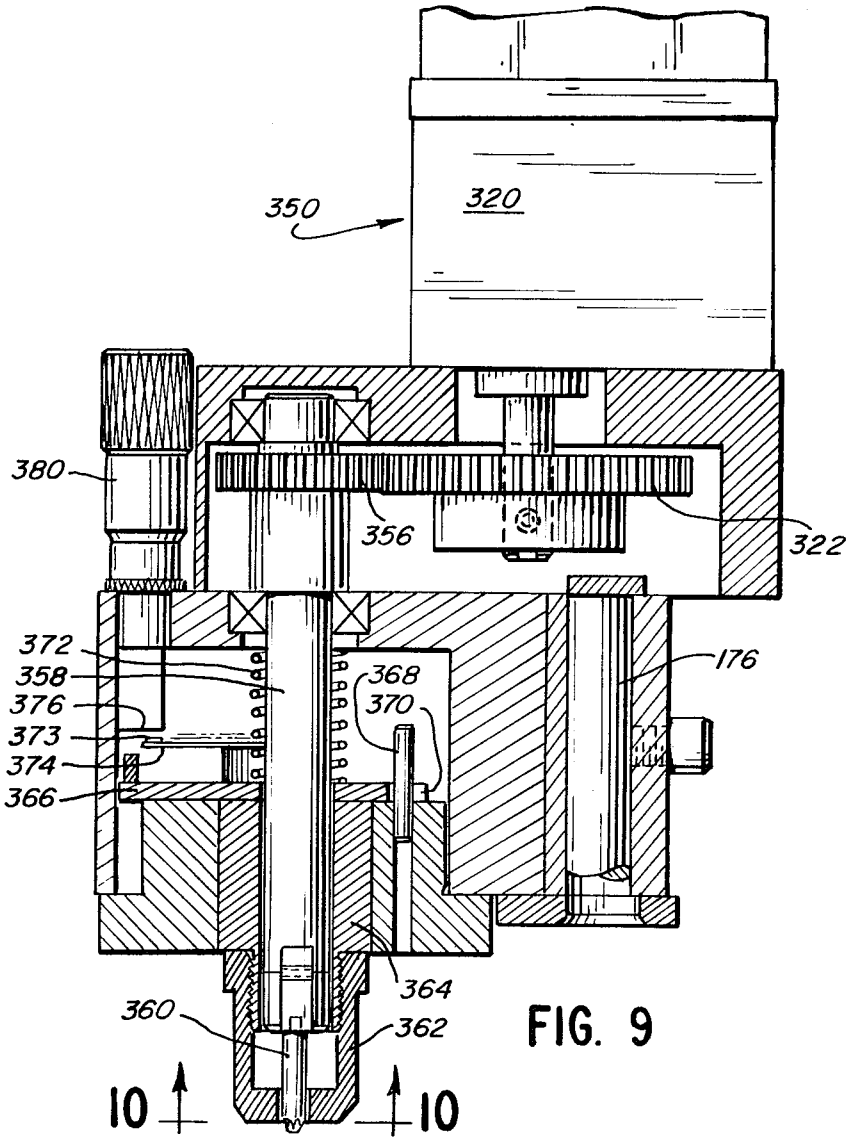
FIG. 9 is an enlarged, diagrammatic cross-sectional view of another interchangeable, head-engaging means for rotating and testing depth of recess provided in a blank whose head is formed with a drive recess therein, such as of the type generally shown in FIGS. 1A, 1B and 1G.

The shaft 150 also carries a cam disc 160 that is constructed so that a portion 162 of disc 160 lies in a plane perpendicular to the axis of shaft 150, and with another portion 164, of disc 160, being shaped as shown, to be inclined to the plane of disc portion 162. A cam follower roller 166 carried on a stud 168 rides against and upon the rotating cam disc 160. The stud 168 is secured to a lever arm 170 which is arranged to pivot on a fixed fulcrum pin 172 to provide a second class lever. As best seen in FIG. 2, an extended end of lever 170 operates against a distal roller 173 carried on a stud 174 that connects to and moves with a vertically reciprocable shaft 176. Vertical motion of shaft 176 effects timed raising and lowering of a drive means, such as shown in FIGS. 7 and 9, and whose action is to be described hereinafter, that is positioned to timely engage and drive the head of a blank carried in the V-notch 106 of table 100 when the blank is in the dwell position for testing shown in FIG. 6.

Figure 10:
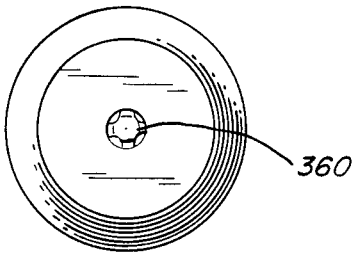
FIG. 10 is a bottom plan view of the means for rotating a blank whose head is recessed to accept a driver therefor, and is taken substantially on line 10—10 of FIG. 9.
Figure 11:
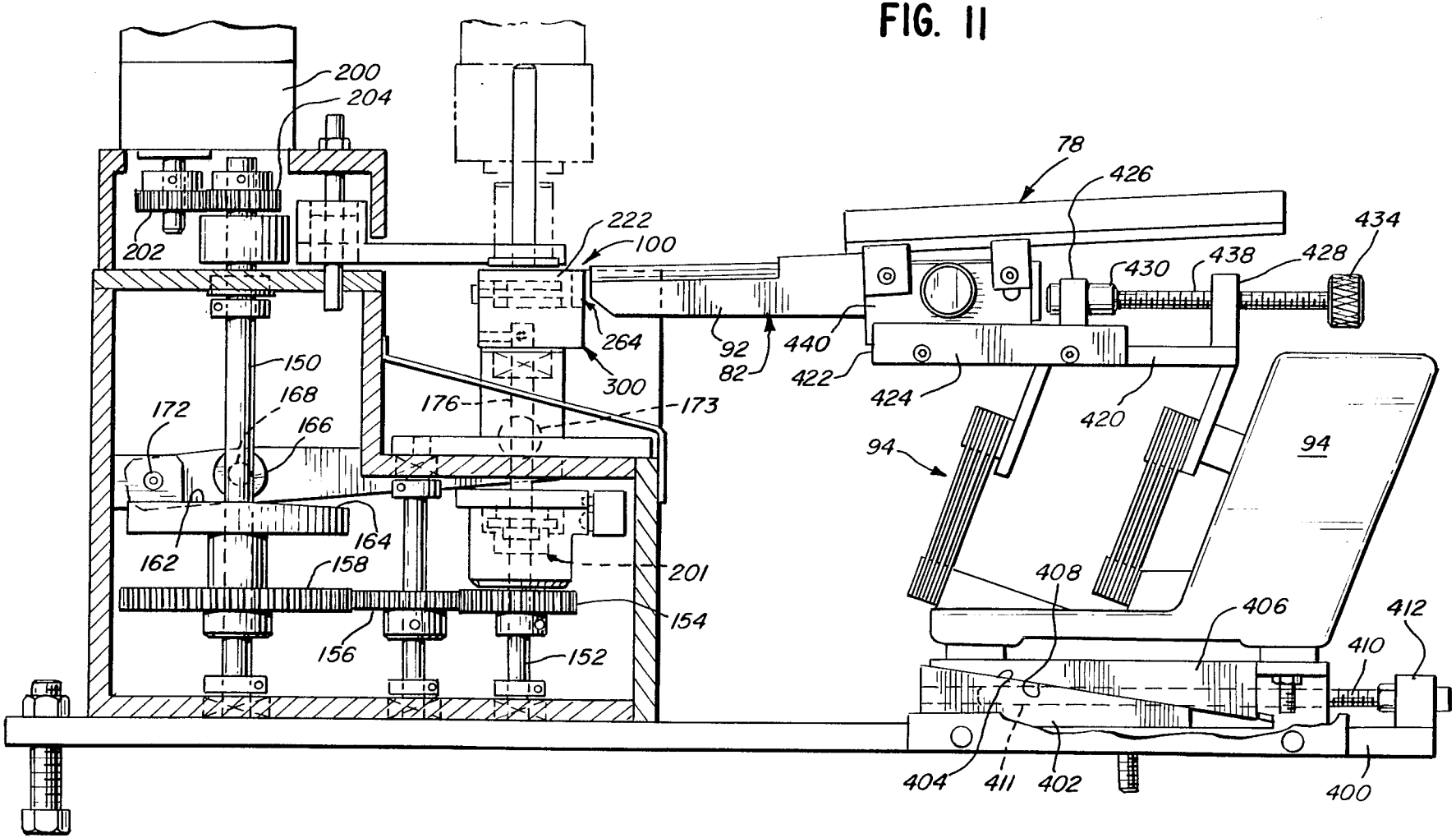
FIG. 11 is a diagrammatic, side elevational, view showing the layout, arrangement, and means for raising and lowering the head gauging means of the types shown in FIGS. 7 and 9, and also illustrating means for selectively adjusting the elevation and lateral location of the discharge end of the feeder track that delivers blanks to the V-shaped, blank-receiving, recess provided on the rotatable test table, that is shown in plan view in FIGS. 5 and 6, and in enlarged plan view detail in FIG. 12.

As may be seen most clearly in the combination cross-sectional and elevational view in FIG. 11, the drive means for the various gears and the drive trains includes a drive motor 200 whose shaft, with drive gear 202 thereon, powers the drive shaft 150 through the transfer drive gear 202 which meshes with and drives a gear 204 that is keyed to the upright shaft 150. The shaft 150, acting through the gear train 158, 156, 154, seen in both FIGS. 2 and 11, drives the rotatable table 100 through a clutch and cam timer means 201, that is constructed and arranged so that the V-notch 106 on table 100 is normally positioned, as the onset of a test cycle, to receive a blank 10 from the discharge end of track section 82, with the table 100 residing, or dwelling, in its blank-receiving position, seen in FIGS. 2 and 5, for four (4) seconds. Shaft 152 then rotates pick-up table 100 and the blank in V-notch 106 from the blank-receiving position of FIG. 5 to the blank-testing position of FIG. 6, where the table 100 and the blank it carries dwell for eleven (11) seconds. During that 11 second dwell period, the head of the blank in V-notch 106 is engaged and rotated, alternately in opposite directions, by means to be described in connection with FIGS. 7–8, or FIGS. 9–10, depending upon the type of blank being tested. Simultaneously, the shaft 150 continues rotating, thereby causing the crank 122 to move, through the means shown in FIG. 2 and as described above, so that the feeler 120 will move in a manner to test the head of the blank, that is in V-notch 106, for eccentricity or formation defect. At the same time, the rotation of cam disc 160, operating through follower roller 166, lever 170, roller 173 and reciprocating shaft 176 operates to move a blank-driving means downwardly from an elevated position into a lowered position at which the blank-driving means will rotate the blank during a portion of the 11-second dwell period.

After the 11-second dwell period, during which the table 100 is in the position shown in FIG. 6, the rotation of the rotatable pick-up table 100 continues, in its counterclockwise direction as seen in FIG. 6, operating to complete the remainder of the 360° of rotation in the next 15 seconds. From the timing disclosed, it will be understood that table 100 is rotated completely twice during a one-minute time span, so that two blanks may be tested per minute. During a portion of the remainder of rotation of table 100 away from the dwell position seen in FIG. 6, the head of a blank 10 that is being carried in V-notch 106 is caused to move against the extended end of a sweep-off arm 206 seen in FIG. 2, 5 and 6, and whose extended end 208 is positioned to overlie table top 102 and to operate to engage the head of blank 10, to insure positive discharge of the tested blank 10 from the V-notch 106, thereby preparing pick-up table 100 for a new cycle of operation. The time of each cycle of operation is selected to be such that examination of a random sample blank is completed before the remainder of the blanks, from which the sample was taken, reach a discharge station at the end of the belted conveyor 98.

Details of construction of the table 100 and its V-notch 106 are shown in FIGS. 12 and 14. It will be understood that the table 100 is specially constructed so as to facilitate interchange, upon the table, of members provided with V-notches having different and various depths of V-angles to accomodate within the V-notch a different stem diameter of a blank. The purpose of the flexibility of construction of table 100, as shown in FIGS. 12–14, is to accommodate blanks of various stem diameters while keeping the axis of the stem blank at a fixed distance from the center of rotation of the table 100. Interchange of a V-notched part, with a rectangularly notched part, is also readily accomplished to accomodate blanks with counter-sunk heads, as earlier observed.

As specifically illustrated in FIGS. 12–14, the rotatable table 100 includes a support member, generally 209, of a general U-shape as seen in FIGS. 13–14, which arrangement provides a heavy horizontal base, or bight, 210 and a pair of laterally spaced, upright legs 211 and **211*a* that extend upwardly relative to base 210. The base 210 is provided with a downwardly opening, vertically extending socket, or bore, 212 for drivingly receiving thereinto the upper end of the table's rotatable drive shaft 152. Any appropriate drive connection may be provided between drive shaft 152 and the walls of bore 212, such as a non-circular telescoping arrangement, or by a key and keyway. A central portion of the upper surface 216 of base 210 is depressed and arcuately shaped at 217, as best seen in FIG. 13, to slidably receive therein a longitudinally adjustable, generally cylindrically shaped, body portion 219 of an axially movable, elongated, body 218, whose uppermost surface is truncated, or flatted, at 220 to provide a planar support for a flat top plate 222, that is part of an interchangeable element that is constructed and arranged to be supported on flat top 220 and to be secured to body 218**.

A transverse cross plate 224, that serves as an axial abutment, is provided of a length to overlie the two upright spaced legs 211 and **211*a*, and said abutment 224 is removably secured by appropriate means, such as two socketed cap screws 226, to the edges of the legs 211 and 211*a* of the U-shaped member 210, that are distal from the V-notch 106**.

The U-shaped support member 209, and the cross plate 224 secured thereto together provide an elongated chamber, or recess, 225 within which the elongated movable body 218 is axially slidable. To provide a means for selectively, longitudinally, locating the elongated body 218 within said chamber 225, the body 218 is axially bored and tapped at 227. A rotatable adjustment member, in the form of an elongated, threaded bolt, generally 228, is constructed and arranged to threadably cooperate with the tapped bore 227 in elongated body 218. A rotatable member, generally 228, is formed at the outer end of adjustment member 228, to include an outermost hex-shaped head 230 and a washer-like retainer 232 that is spaced from hex-head 230, an elongated cylindrical stem 234 that interconnects hex-head 230 and the retainer 232, the latter being spaced from head 230, and an elongated screw-threaded stem 236 that is sized to cooperate with tapped bore 227 in body 218.

The cross plate 224 is provided with an elongated slot 237 therein that extends vertically upwardly from the lower edge 240 of plate 224. The rotatable member 228 is sub-assembled with cross plate 224 and body 218 before cross plate 224 is attached to support member 209 by the two cap screws 226. The length of cylindrical stem portion 234, between head 230 and retainer 232, is slightly greater than the thickness of the portion of cross plate 224, so that when stem 232 is slid into assembled position, as seen in FIGS. 13 and 14, through elongated slot 237, thereby positioning hex-head 230 outwardly of the outer surface of cross plate 224 and with retainer 232 located adjacent the inner surface of cross plate 224, the assemblage will be in the condition as seen in FIGS. 12 and 14. The threaded stem 236 is assembled in the tapped bore 227 of elongated body 218 before assembly of the structure seen in FIG. 12. The corners and edges of elongated body 218 are beveled at 238 to assure no interference, or snagging, between the interfitted, adjacent, members.

The arrangement of parts as described above operates to provide means for selectively locating body 218 precisely relative to chamber 225 and to top plate 222 mounted on body 218. Rotation of member 228, by gripping, such as with a socket headed tool, and rotating head 230, operates to slide elongated body 218 in opposite longitudinal directions as desired. The retainer 232 which abuts cross plate 234 prevents lost motion between rotatable member 228 and body 218.

The foregoing features of construction described are for the purpose of providing for accurate location and precise adjustment of an interchangeable top plate 222 that carries a V-notch 106 therein.

The flatted top side 220 of body 218, is adapted to support the flat top plate 222 thereagainst. Top side 220 has three tapped bores therein arranged with their longitudinal axes aligned, as seen in FIG. 14. The middle tapped bore 242 is of smaller diameter than the two adjacent tapped bores 244 and 246. Bore 242 is adapted to receive therein a threaded set screw 248 whose lower end clamps a resilient pad-like member 250 against the threaded stem 236 to hold the threaded stem 236 in a locked position relative to the tapped bore 227 in body 218. The set screw 248 does not project above flatted side 220 of member 218. Set screw 248 has a recessed socket 252 in its upper end for receiving a screw manipulating tool.

As will be seen in FIGS. 13 and 14, the leg 211 of the U-shaped support 209 extends upwardly further from the base 210 than does leg 211*a*. The leg 211*a* provides a support surface 220 for a plate member 256 that is shaped to provide thereon a portion 256*a* of the flat top side 102 of table 100, and including the cylindrical arcuate edge section 104. Plate 256 has an outermost arcuate edge 104 that is concentric with and spaced radially inwardly of the circularly shaped edge 114 that is best seen in FIG. 2. The plate member 256 is secured to leg 211*a* by a pair of spaced threaded bolts 259 and 260 that are provided with hex-socketed ends in the bolt heads, as seen in FIG. 12, for effecting selective tightening or loosening of bolts 259 and 260.

The tapped bores 244 and 246 in body 218 are adapted to respectively receive the threaded stems of clamp bolts 254 and 256. The top plate 222 is provided with enlarged bores 258 and 260 for slidably receiving therethrough the threaded stems of clamp bolts 254 and 256. The heads of clamp bolts 254 and 256 function to clamp top plate 222 tightly against flatted side 220 of body 218.

The top plate 222 is elongated and is part of an interchangeable element 223 that is to be supported on body 218 and to be selectively clamped thereto by clamp bolts 254 and 256. The interchangeable element lies adjacent and between the parallel legs 211 and 211*a* of support member 209, and is shaped to provide at the radially outermost end thereof a vertically extending end section 264 that projects downwardly and transversely of top plate 222. Said end section 264 has a planar rear surface 266 that is adapted to abut the longitudinal end of body 218 that is distal from cross plate 224. The front, or radial outermost, portion of end section 264 is formed to provide the upright walls 108 and 110 that serve to define a V-notch 106 and to provide the edge traces 108 and 110 of the V-notch 106. The radial outermost portion of end section 264 is also provided at its upper end thereof with arcuately spaced segments 274 each of which has an outermost, arcuate, cylindrical periphery 276. The top plate 222, and its vertical end section 264 with its upright walls 108 and 110, and its arcuate cylindrical edge sections 276, constitute a replaceable section that provides a V-notch of a selected shape for table 100 as needed or desired. The end section 264 has a planar rear surface 266 that is adapted to abut the end of a body 218 that is distal from cross plate 224. The front, or radial outermost, portion of end section 264 is formed to provide thereon the upright walls 108 and 110 that serve to define the V-notch 106, providing the edge traces 108 and 110. The front portion of end section 264 is also provided at its upper end thereof with arcuately spaced segments 274 each of which has an outermost, arcuate, cylindrical edge section 276 that is to be spaced closely adjacent cylindrical edge 117 of the confining wall 112.

As best seen in FIGS. 12 and 14, the shape of the interchangeable element is such as to provide support for the head of a blank whose unthreaded stem 12 contacts, and is tangent to, the two vertical walls of the V-notch 106 which provide the edge traces 108 and 110.

By varying the shape of V-notch 106, a V-notch space provided for receiving and properly positioning a stem 12 of a fastener blank can be selected, and this factor is a basis for securing a versatile construction, by providing for interchangeable elements that each includes a top plate 222 and a vertically extending end section 264, such element being referred to as 222–264. The interchangeable element 222–264 is easily removed and replaced, by another interchangeable element having similar parts but a different shaped V-notch 106, merely by removing the two clamp bolts 254 and 256.

Although the interchangeable element consisting of plate 222 and end section 264 has been described in particular with a V-notch 106 therein, and with the head of the blank supported on the upper surface of the element, it will be understood that an element for receiving a blank having a head shaped for countersunk fasteners could also be provided, but then a V-notch is not used and instead a rectangular notch is used.

It can be seen that the diameter of stem S of a blank, such as the stem of blank 10, is so related to the size and angle shape of the V-notch 86, that only a very small section of the blank's stem S will project radially outwardly of the V-notch 86, as best seen in plan view in FIG. 12. The hex-head of the blank, illustrated in broken lines, shows how the surfaces adjacent traces 108, 110 provide a support means for the blank's head.

Figure 8:
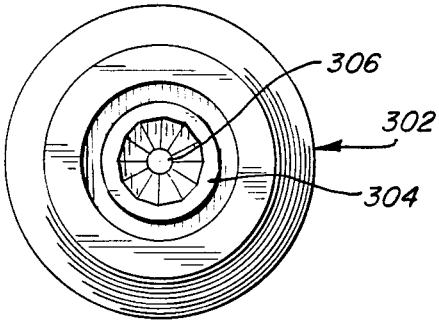
FIG. 8 is a bottom plan view of the means for rotating a hex-headed blank, and is taken on line 8—8 of FIG. 7.

When a headed blank, such as 10 (typically as in FIG. 1) is located in the dwell position illustrated in FIG. 6, and as explained earlier in the description of operations of the apparatus illustrated in FIG. 11, the engagement of cam follower 166 with the portion 164 of cam disc 160 operates to move shaft 176 downwardly, and to lower the head testing mechanisms, of the types shown in FIGS. 7 and 8, or of FIGS. 9 and 10, into a position for sampling the blank's head positioned in the FIG. 6 position.

As seen in FIG. 7, one head testing mechanism, generally 300, is secured by a set screw 301 to shaft 176. As the testing mechanism 300 moves down to its operating position in timed relation to movement of the blank into the position of FIG. 6, a cylindrical testing head, generally 302, provided with an appropriate socket 304, shaped and selected to cooperate with the head of the blank to be tested, moves down to surround and drivingly engage the blank's head. A typical driving socket 304 is shown in FIG. 8, wherein a twelve-corner engaging recess, as seen in FIG. 8, is provided for quick coupling of the socket to the hex-head of a headed blank being tested. A depth gauge, or feeler stem, 306, located coaxial of socket 304 is for measuring the depth of the socket surrounded by the hex head, and fits telescopically inside, and concentrically with, the testing head 302 and projects a pre-selected distance into the socket 304. If the depth of socket is inadequate by being not deep enough, the feeler 306 will be lifted upwardly against a pin 308 that is spring biased downwardly by a coil spring 310. Upward movement of the upper end of pin 308 will move structure that carries a spring blade 311, with an electrical contact 312 thereon, into electrical contact with an electrical contact 314, whose position relative to first contact 312 is preferably micrometer controlled. Contact will operate to close an electrical circuit. Closing of the circuit issues a signal that stops further production of blanks by the producing machine.

The remainder of the mechanism illustrated discloses known means for rotating the hex-head blank, so that the periphery thereof may be tested by the feeler blade 120 whose operation is described hereinabove. The mechanism that effects rotation of the headed blank, for purposes of this test is made by another source, and is well known in the art. The construction includes an electric motor 320 that is pre-programmed to rotate the blank being tested, alternately in opposite directions while the exterior of the hex head is simultaneously being examined by the laterally movable feeler 120 for detecting defects in the shape of the blank's head. The electric motor 320 drives a first gear 322 which transmits rotary motion to second gear 324. Rotation of the second gear 324 transmits motion through a pair of drive pins 326 to an elongated sleeve 328 which is drivingly connected through the recess in socket 304 (FIG. 8) with the hex corners of a hex-headed blank. It will be readily understood that the shape of the driving socket 304 may be selected as desired for a headed blank, and forms no part of the invention herein.

As seen in FIG. 9, an alternative head testing mechanism, generally 350, is designed to test or gauge the depth penetration of a driver tool into the socket provided in the head of a blank for a Phillips, slotted, Pozidrive, or recessed TORX TM, blank. The driving tool 360 is selected of a shape to serve to effect a driving connection with the specific indented head of the blank. The depth gauge includes the spacing between the terminal of the probe 360 and the annular feeler 362, the latter being threadably connected to an axially slidable sleeve 364, which abuts an annular plate 366, whose angular position is insured by stem 368 located in recess 370 of part 366. A spring 372 normally biases the parts 366, 364 and 362 to the position seen in FIG. 9. An electrical contact-carrying, spring blade, 374 is movable toward or away from contact with a conductor 376 whose position is controlled by micrometer 380. If the correct recess depth in the blank exists, then the movement of the parts brings contact 373, on spring blade 374 into contact with electrical conductive member 376. If this contact is not made then a defect exists and a signal is then supplied to stop production by the blank producing machine. The spring blade 374 abuts and moves with parts 366, 364 and 362.

The use of micrometer mounted contacts in the various forms of testing devices disclosed provides control means for fine tuning, or accurately setting, the amount of variation that will be tolerated before the machine producing the blanks will be cut off from further production.

Figure 15:
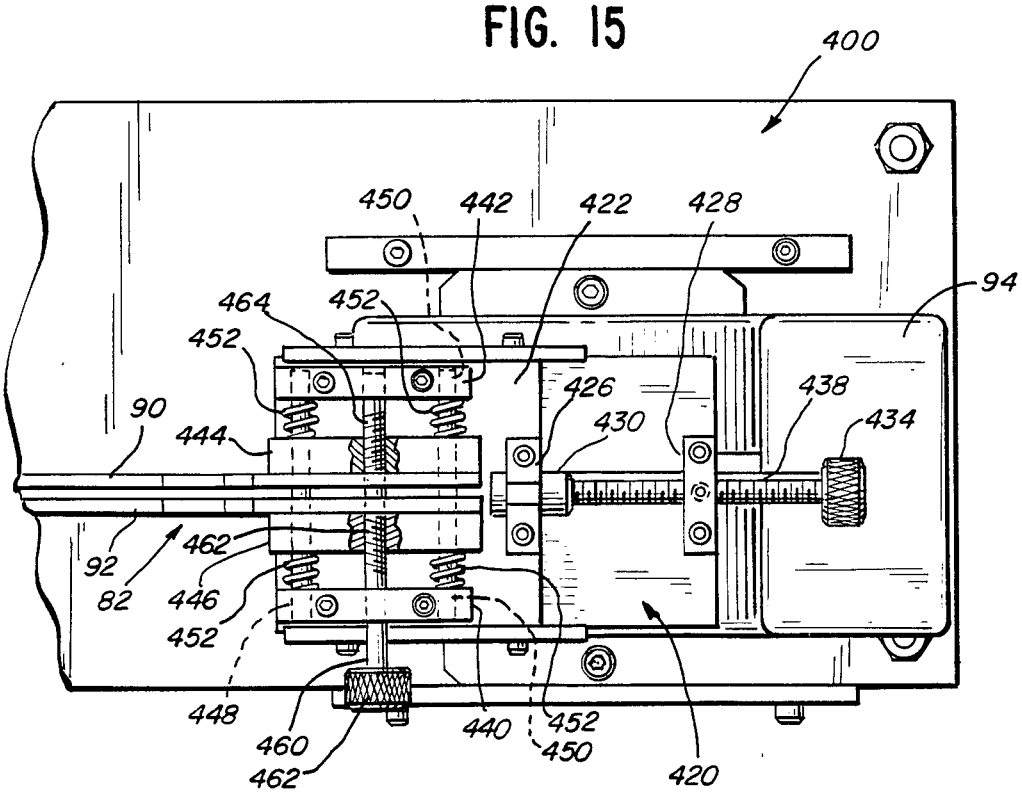
FIG. 15 is a fragmentary plan view of the right hand portion of the view seen in FIG. 11, and shown partly in section, and illustrating certain details of the means for selectively adjusting the spacing of the spaced rails of the feeder track that transports acceptable blanks to the V-shaped, blank-receiving, recess provided in the rotatable testing table.

As best seen in FIGS. 11 and 15, the apparatus disclosed above is also provided with improved track means for transferring to the rotatable sampling head 100, random sample blanks, that have passed the first test that focused on testing the dimension of all blank heads passing through a roll sorter. The improved track means are illustrated in FIGS. 11 and 15 and will now be described.

FIG. 15 illustrates in a plan view, with parts omitted for clarity, and other parts shown partially in elevation and partially in section, how a number of sections of the machine are interrelated to each other, showing in elevation some portions of the machine that are shown illustratively in perspective in FIG. 2, and showing other portions of the machine that are also seen illustratively and in section in FIG. 11.

Thus, FIG. 15 taken in conjunction with FIG. 11, shows an elongated base, or support, generally 400, above which are positioned the inclined transfer shelf or tray 78 (seen in perspective in FIG. 2) that is constructed to funnel accepted blanks toward a transfer track section, generally shown at 82. The vibrator apparatus 94 of FIG. 2 is also seen in FIGS. 11 and 15, but, as shown in FIGS. 11 and 15, there are included both height adjustment means and longitudinal adjustment means for the transfer track section 82, particularly for selectively locating the discharge end of track section 82 relative to the rotatable table 100.

Thus, there is mounted on an elongated base, generally shown at 400, and located between base 400 and the vibrator apparatus generally shown at 94, a first selectively adjustable means that is used for selectively varying the elevation, or vertical spacing, of track section 82 above base 400 and relative to the top of rotatable table 100. This elevation adjustment means, best seen in FIG. 11, includes a lower support block 402 positioned on base 400 and provided with an inclined ramp surface 404 facing upwardly and rearwardly, to the right relative to the flow of blanks along track section 82, and an upper support block 406 with an inclined ramp surface 408 for mating with ramp surface 404 but facing downwardly and abutting inclined ramp surface 404 to provide for camming sliding therebetween, the camming operating being to selectively raise or lower track section 82 relative to base 400.

An elongated adjustment screw means 410 seen in FIG. 11 is threaded through a fixed abutment member 412 carried on base 400. The extended end of screw means 410 slidably passes through an elongated passage in upper block 406 but is operatively threadedly, secured to lower support block 402, to provide means for converting the relative sliding movement, between inclined upper block 406 and inclined lower block 402, to vertical movement. Since upper block 406 supports vibrator 94 thereon, which in turn supports a structure from which the track means 82 project, means are provided by the pair of abutting bevel blocks 402 and 406, and by the adjustment screw means 410 for converting horizontal movement of lower block 402 relative to upper block 406, under influence of screw means 410, to effect a controlled selective vertical adjustment of the track means 82 relative to the top of table 100. The rotatable table 100 is supported spaced from the left hand end of track means 82, as seen in FIG. 11.

The vibrator structure 94 has mounted thereon, a horizontally extending, support member or plate 420, seen in side elevation in FIG. 11, and in top plan in FIG. 15, and upon which is slidably disposed an upper movable structure 422 that is adapted to be selectively moved in opposite horizontal directions relative to support 420. The support 420, by being secured to vibrator 94, is subject to being vibrated, but otherwise serves as a support. An upright abutment block 428 is secured to the upper side of the support 420. An elongated screw threaded, adjustment member, 438 is screw threaded through a threaded bore that extends through abutment block 428. One end of elongated adjustment member 438 is provided with a manually actuatable control knob 434. The end of elongated adjustment member 438 that is distal from control knob is operatively associated with an upright abutment member 426 that is secured to and movable with an upper support plate 422 that is supported on, but is slidable relative to the lower support plate 420.

By rotating the manual control 434, the upper movable support plate 422 can be selectively moved in opposite directions relative to the fixed plate structure 420. The selectively movable upper plate structure 422 is operatively associated with the blank-receiving tray 78, and with the transfer track 82. By manually rotating the manual control 434, the extended, or discharge, end, of transfer track 82 can be selectively moved radially toward or away from the V-notch 106 on the rotatable table 100, so as to selectively control the point of discharge of blanks from the extended discharge end of transfer track 82 to table 100.

As best seen in FIG. 15 and in FIG. 2, the transfer track 82 for feeding blanks onto table 100 is made up of a pair of parallel, spaced, transfer rails 90 and 92. As best seen in FIG. 15 the spaced parallel rails 90 and 92 are respectively secured at their ends distal from table 100 to a pair of parallel, spaced, inner block members 444 and 446, with rail 90 secured to block 444 and rail 92 secured to block 446.

The blocks 444 and 446, as best seen in FIG. 15, are part of an assemblage that includes parallel outer fixed blocks 440 and 442 which are mounted on said upper movable plate structure 422. A pair of parallel, spaced, cross rods 448 and 450 extend between and are secured to outer blocks 440 and 442. The outer blocks 440 and 442, mounted on and secured to movable plate 422, provide lateral supports for the parallel cross rods 448 and 450. The pair of inner blocks 444 and 446 are apertured to slide on, and relative to, the cross rods 448 and 450. Coil compression springs 452, are arranged substantially concentrically on cross rods 448 and 450 and are compressed between the respective facing sides of each pair of inner and outer blocks 442–444 and 440–446. An elongated adjustment and controller rod 460, with a control knob 462 thereon is arranged to be operatively associated with inner blocks 444 and 446 to selectively control the spacing therebetween. The controller rod 460 is located to slidably project in or through aligned bores through the outer blocks 440 and 442, but the rod 460 is provided with oppositely pitched screw threads, one being a right hand thread and the other a left hand thread, provided on rod 460 and arranged to cooperate with similar threaded bores provided at 462 and 464 through the inner blocks 446 and 444. By rotating the control knob 462 selectively in opposite directions, the inner blocks 446 and 444 are caused to simultaneously move either toward, or away, from each other, while said inner blocks 446 and 444 are maintained in parallel relation to each other by the aligning cross rods 448 and 450, and the coil springs 452 co-operate to bias the inner blocks 446 and 444, and their associated rail portions 90 and 92 parallel. By this simple control, and the construction described, the spacing between, or operative width, of the track means 82 may be selectively adjusted to accommodate therebetween blank stems of different sizes. The upper edges of the rail portions 90 and 92 provide support for the head of the blank moving along the track means 82.

It will be seen from the foregoing that three simple control means are provided for: (a) selectively adjusting the elevation of the transfer track section 82; (b) for selectively moving the elongated transfer track section 82 longitudinally relative to the top of table 100 onto which blanks are to be unloaded from the transfer track section 82; and (c) for selectively adjusting the spacing of the parallel spaced tracks 90 and 92 of the transfer track section, for accomodating movement along said track section of blank stems of different dimensions.

Referring now back to the roll-sorter 42 that is illustrated only in part in FIG. 2, and described in its operation in connection with FIGS. 2–4, certain details of the roll-sorter are illustrated in FIGS. 16–18.

In order to hold the rollers 44 and 46 in alignment, and their drive motor 48 in properly spaced and operative relationship, the rollers 44 and 46, and the drive motor 48 therefor, are mounted on suitable structural frame elements, generally indicated at 500, as seen in FIGS. 16–18. As seen in FIG. 16, the drive motor 48 is spaced laterally, by a motor mounting structure 502, from the rollers 44 and 46. Said rollers 44 and 46 are effectively framed by a generally elongated, rectangular, support structure 504 that effectively holds the rollers 44 and 46 in longitudinal alignment with each other. Toward this end, portions of the elongated rollers 44 and 46 are supported and journalled adjacent one end thereof in support blocks that are supported on a first cross support **504*a*, while the opposite ends of rollers 44 and 46 are similarly supported and journalled in support blocks supported by a second cross support 504*b***.

A roller drive, in the form of an endless belt or chain member, and hereinafter referred to as drive belt means 49 is trained over a drive sprocket **48*a* that is driven by an electric motor 48 and, as best seen in elevation in FIG. 17, extends toward the rollers, being first trained over a pivotable idling roller, sprocket, or sheave 506 that is mounted at the end of an adjustment arm 508 that is secured by adjustment bolt 510 to an appropriate portion of frame 500. The drive belt means 49 then extends to a position that operatively engages and drives the lower edge of a second sheave, or sprocket, 52, which is operatively associated with roller 46, and then extends to be trained over the upper edge of first sheave, or sprocket, 50 that is operatively associated with roller 44. The endless drive belt, or chain, 49 then passes over a portion of the periphery of an idling, locating, sheave 510 and returns to complete the endless loop about drive sprocket 48*a***.

The generally rectangular support structure 504 is suitably reinforced, in a manner known in the art and whose details would needlessly extend the length of this Specification. It is sufficient to note that vertically extending, elongated, threaded bolts 512, as seen in FIG. 18, provide means for mounting the frame structure 504 at a desired elevation and provide means for leveling the roll sorter. Also, there are means provided for laterally adjusting the spacing of the journals for the rollers 44 and 46, as illustrated generally by the screw adjustment means 514 seen in FIGS. 17 and 18. A portion of the spacing 45 between rollers 44 and 46 may be protected from having blanks feed into space 45 by means of a hood 516. The general location, and mounting, for the proximity switch 76 on the support structure 504 is illustrated in FIG. 16.

It will, of course, be understood that modification of the present invention in its various aspects will be apparent to those skilled in the art, some being apparent only after study and others being a matter of routine design. Further, the use of the particular components and component shapes described herein are not necessary features of the present invention. As such the scope of the invention should not be limited by the particular embodiment and specific construction herein described, but should be defined only by the appended claims and equivalents thereof.

What is claimed is:

1. In an assaying apparatus for determining the acceptability to pre-selected specifications of each blank of a continuous output of individual, cold-formed intermediate blanks for fasteners and the like from a cold-forming machine, each blank including an axially elongated stem with a work-entering end and a head end, the head end of the stem being formed integrally with a head section that is of greater maximum transverse dimension than the transverse dimension of the elongated stem, the head section having means adapted to be engaged by a driving tool for rotating the finished fastener;

the improvement in the assaying apparatus comprising, in combination:

first assaying means for preliminarily assaying each blank of the continuous output of blanks, to provide a continuous output of first assayed blanks having maximum transverse dimension of the respective head sections within a pre-selected first dimensional range, by rejecting blanks having head sections with dimensions outside of said range, said minimum dimension of said range being greater than the maximum transverse dimension of a stem;

means operatively connected to said first assaying means and the cold-forming machine for automatically terminating the output of blanks from the cold-forming machine when said first assaying means rejects a blank;

selection means operatively connected to said first assaying means to select random samples of first assayed blanks;

said selection means including an elongated track means with an inlet end and outlet end, operatively constructed to provide a vertical slot bounded by a pair of spaced support rails along which move, in single file, the random samples of first assayed blanks, the stems of the sample blanks passing through and along said vertical slot from inlet end to outlet end with the respective head section of each sample blank being supported upon and sliding along the upper surfaces of the pair of support rails;

a rotatable table located adjacent the outlet end of said elongated track means, and having a blank receiving and holding recess therein adapted to be alignable with the outlet end of the elongated track means to receive the blank at the outlet end of said track means, the received blank then being positioned with its stem in said recess of the rotatable table, and with the head section of the blank being supported by the rotatable table;

means for rotating the rotatable table with the aforesaid blank in said recess thereof to a second assay position;

second assay means, responsive to the rotation of the rotatable table, for providing a second assay of a blank in the second assay position, said second assay comprising at least two measurements of characteristics of the blank head section other than the measurement made in the first assay, to determine whether said at least two measurements fall within respective predetermined dimensional ranges; and means for terminating the output of blanks when any one of said at least two measurements fails to fall within said respective predetermined dimensional range.

2. A construction as in claim 1 wherein said first assaying means includes an elongated roll sorter having a pair of spaced apart, elongated, parallel rollers, shaped and arranged to provide first and second axially elongated and adjacent sections;

the first section having a minimum spacing that is equal to the minimum acceptable transverse dimension of the head, the second section having a minimum spacing that is equal to the maximum transverse dimension of the head section of a blank to be assayed, and the second section having a minimum spacing that is equal to the maximum acceptable transverse dimension of said head section;

means for discharging blanks to be assayed into said minimum spacing first section, means for rotating and arranging the pair of rollers to move the stem of each blank into the spacing between the rollers, with each blank moving longitudinally along the rotating rollers from the first section toward the second section, first blank receiving means spaced below the first section of the roll sorter for catching and signalling the presence of a blank that has fallen through the slot that is defined between the first adjacent roller sections;

second fastener catching means below the second section of the roll sorter for receiving acceptable assayed blanks; and signal means positioned adjacent the portion of the second section of the roll sorter that is distal from the first section of the roll sorter, said signal means being adapted to be actuated by, and to signal the presence thereat, of a blank that is still supported by the second section of the spaced rollers of the roll sorter and to signal the presence of said blank.

3. A construction as in claim 1 wherein said selection means includes:

a receiver tray having higher portions and a lower discharge portion, for receiving said output of first assayed blanks;

vibrator means operatively associated with the receiver tray for moving the assayed blanks thereon toward said lower discharge portion of the receiver tray, said discharge portion having a lowermost section that is aligned with the inlet end of said elongated track means;

random ones of said first assayed blanks being urged by the vibrator means to align with and enter the elongated track means, one at a time, and the remainder of said first assayed blanks on the lower end of the receiver tray being discharged, under urging from the vibrator means, onto a transfer means that is positioned for receiving first assayed blanks and moving said blanks toward a work station for further manufacture.

4. A construction as in claim 1 wherein said rotatable table has a portion of circular periphery, the blank receiving and holding recess of the rotatable table being V-shaped, with vertical sides defining and vertically extending the V-shape, and with the apex of the V-shape being located spaced from the circular periphery of the table radially of the table's axis of rotation, the upper surface of the rotatable table being located in a plane spaced below the upper edges of the spaced support rails of the track means along which random samples of fasteners move in single file toward said rotatable table.

5. A construction as in claim 4 wherein said V-shaped recess is constructed, relative to the diameter of the stem of the blank being tested, so as to project a predetermined, limited, portion of the blank's stem radially beyond the maximum projected circular periphery of said table.

6. A construction as in claim 5 in combination with a horizontal shelf that is located and shaped to complement said circular periphery portion of the rotatable table, and is adapted to have a portion of the head portion of the blank slide over said horizontal shelf when the rotatable table rotates from the position where it receives the blank from the support rails, and resilient means provided below said shelf and positioned to engage a portion of the stem to hold the stem in contact with vertical sides that vertically extend the V-shape of the blank receiving recess.

7. A construction as in claim 1 wherein said blank receiving and holding recess of the rotatable table is constructed and arranged to be a portion of a replaceable section of said table, to permit an interchange of the replaceable table section to provide different recesses for receiving and accommodating blanks of different stem dimensions and head constructions.

8. A construction as in claim 1 wherein said second assay means is constructed to effect measurement of maximum head diameter, and a measurement of depth of a recess in, the head of the blank.

9. In a machine for assaying a headed blank and stem for a fastener, where the headed blank and stem is produced as an intermediate product in the course of preparing the fastener's blank and stem for cold rolling thread means on the stem of the blank, the improvement of means including a rotatable table, for such an assaying machine, and comprising, in combination:

a base means for the table, said base means being shaped and arranged to provide a bottom wall and a pair of spaced upright walls extending along at least a portion of the opposite sides of the bottom wall;

an axially elongated body supported on said bottom wall, and constructed to be selectively moved axially of said bottom wall in opposite directions along said bottom wall and between said spaced upright walls;

and a selectively interchangeable head-and-stem receiving means, adapted for cooperation with a blank's head and stem means, provided on said table; said interchangeable receiving means being in the form of an L-shaped member, the long leg of which is constructed and arranged for selective assembly onto, and disassembly from, said movable elongated body, and the short leg of which is provided on its outermost face thereof with a V-shaped notch formed therein and extending perpendicular to the plane of the long leg, said V-shaped notch being constructed and arranged to have the cylindrical periphery of the stem of a blank simultaneously engage, in tangent relation to and against, the two walls of the V-shaped notch defined on the head-and-stem receiving means of the rotatable table.

10. In a machine for assaying an intermediate product consisting of a headed blank and an unthreaded stem, that is produced by an automatic production machine as an intermediate product leading to ultimate formation of a headed, threaded, fastener, the intermediate product being formed with a head portion and a non-threaded stem portion extending from one side of the head portion;

the improvement providing, in combination; a rotatable table for receiving sample blanks as part of a process for determining if the character of the blanks meet predetermined production specifications; the table and the sample thereon being movable to at least one test station that is other than the station at which a formed blank is received by the table;

the means for moving a blank to the blank receiving table including a pair of spaced, parallel, inclined tracks between which the stem of a fastener blank moves, as the blank advances to the table, for testing on the table, the dimensional character of the blank;

a first means for selectively adjusting the height of the pair of parallel tracks relative to the table onto which a specimen blank is to be delivered from said parallel tracks;

a second means for selectively longitudinally adjusting the position of the discharge end of the track means for moving the blank relative to the portion of the table adapted to receive a sample blank;

and a third means for selectively varying the spacing of the pair of parallel tracks between which the stem of the headed blank and stem moves toward the rotatable table.

11. A construction as in claim 10 wherein the third means includes a rotatable adjusting member having thereon two sets of threads, one a right hand thread and the other a left hand thread; said threads being arranged for simultaneous cooperation with the two spaced parallel tracks for simultaneously moving said pair of parallel tracks either toward or away from each other, so as to selectively vary the spacing between said parallel tracks; and means, separate from said threads on the adjusting member, and operatively associated with the two tracks for maintaining said tracks in parallel relation to each other as the tracks are moved toward or away from each other.

* * * * *